US006810554B2

(12) United States Patent
McKay

(10) Patent No.: US 6,810,554 B2
(45) Date of Patent: Nov. 2, 2004

(54) CLEANING TOOL WITH REMOVABLE CLEANING SHEETS

(75) Inventor: William D. McKay, Grand Blanc, MI (US)

(73) Assignee: Rapid Brands Corporation, Flint, MI (US)

( * ) Notice: Subject to any disclaimer, the term of this patent is extended or adjusted under 35 U.S.C. 154(b) by 287 days.

(21) Appl. No.: 09/993,137

(22) Filed: Nov. 16, 2001

(65) Prior Publication Data

US 2002/0083964 A1 Jul. 4, 2002

Related U.S. Application Data

(63) Continuation-in-part of application No. 09/979,415, filed as application No. PCT/US99/12945 on Jun. 11, 1999, now abandoned, and a continuation-in-part of application No. 09/602,189, filed on Jun. 12, 2000, now Pat. No. 6,405,403, which is a continuation-in-part of application No. 09/094,551, filed on Jun. 12, 1998, now Pat. No. 6,298,517.

(60) Provisional application No. 60/311,463, filed on Aug. 11, 2001, and provisional application No. 60/260,969, filed on Jan. 10, 2001.

(51) Int. Cl.[7] ..... A47L 13/20

(52) U.S. Cl. ..... 15/228; 15/104.002; 15/227; 15/231

(58) Field of Search ..... 15/104.002, 104.94, 15/144.1, 220.1, 223, 227, 228, 231, 232

(56) References Cited

U.S. PATENT DOCUMENTS

| | | | | |
|---|---|---|---|---|
| 466,337 A | | 1/1892 | Fries | 15/231 |
| 722,863 A | | 3/1903 | Lodge | 15/227 |
| 866,897 A | | 9/1907 | Willey | 15/232 |
| 1,146,668 A | | 7/1915 | Tanaka | 15/228 |
| 1,587,670 A | | 6/1926 | Nebelung | 15/231 |
| 1,643,722 A | | 9/1927 | Millen | 15/227 |
| 1,716,171 A | * | 6/1929 | Kenji | 15/232 |
| 1,852,114 A | | 4/1932 | Green | 15/104.93 |
| 1,946,321 A | | 2/1934 | Hunter | 15/228 |
| 2,039,594 A | * | 5/1936 | Hunter | 15/231 |
| 2,079,452 A | * | 5/1937 | Hunter | 15/231 |
| 2,226,654 A | | 12/1940 | Bates | 15/231 |
| 2,301,505 A | | 11/1942 | Bates | 15/231 |
| 2,414,872 A | | 1/1947 | Harter | 15/231 |
| 2,465,194 A | | 3/1949 | Brouty | 15/231 X |
| 2,648,863 A | | 8/1953 | Darling | 15/231 |
| 2,693,610 A | | 11/1954 | Hensley, Jr. | 15/104.002 |

(List continued on next page.)

FOREIGN PATENT DOCUMENTS

| | | |
|---|---|---|
| EP | 202 113 | 5/1986 |
| EP | 265 684 | 5/1988 |
| GB | 459921 | 1/1937 |
| GB | 2310796 | 10/1997 |

*Primary Examiner*—Mark Spisich
(74) *Attorney, Agent, or Firm*—Gifford, Krass, Groh, Sprinkle, Anderson & Citkowski, PC

(57) ABSTRACT

A refill is designed for use with a mop of the type having a mop head with a lower surface and an opposed upper surface interconnected by a leading and a trailing edge. The mop head has a gripper device on its upper surface for retaining a cleaning sheet on the mop head. The refill includes a base layer with a front edge and an opposed rear edge, and a midportion between the front and rear edges. The base layer is designed to be wrapped about the mop head with the midportion adjacent to the lower surface of the mop head and the front and rear edges wrapping onto the upper surface of the mop head so as to be retained by the gripper. Multiple cleaning sheets are each removably supported on the midportion of the base layer in a stacked configuration. Each of the sheets has an outward face for cleaning and an opposed inward face. The outward face of each of the sheets is designed to contact a surface to be cleaned and to thereby become soiled. When the outward face of the outermost sheet becomes soiled, the sheet may be peeled away to expose a non-soiled sheet.

48 Claims, 11 Drawing Sheets

U.S. PATENT DOCUMENTS

| | | | | |
|---|---|---|---|---|
| 2,702,913 | A | 3/1955 | Walkama | 15/104.002 |
| 2,708,761 | A | 5/1955 | Berquist | 15/104.002 |
| 2,739,334 | A | 3/1956 | Hardey | 15/231 |
| 2,756,549 | A | 7/1956 | Macullar | 451/491 |
| 2,870,475 | A | 1/1959 | Scheuer et al. | 15/231 |
| 3,199,136 | A | 8/1965 | George | 15/231 |
| 3,273,192 | A | 9/1966 | Mazzella | 15/144.1 X |
| 3,376,595 | A | 4/1968 | Cole | 15/228 |
| 3,506,996 | A | 4/1970 | Brennan | 15/144.1 |
| 3,613,146 | A | 10/1971 | Oviatt | 15/231 |
| 3,742,547 | A | 7/1973 | Sohmer | 15/104.002 |
| 3,827,100 | A | 8/1974 | Griffin et al. | 15/229.2 |
| 4,114,223 | A | 9/1978 | Buchanan | 15/228 |
| 4,712,268 | A | 12/1987 | Heinonen | 15/231 |
| 4,817,229 | A | 4/1989 | Sedillo | 15/144.1 X |
| 4,937,910 | A | 7/1990 | Frazier | 15/231 |
| 4,991,250 | A | 2/1991 | Young | 15/228 |
| 5,012,542 | A | 5/1991 | Lynn | 15/1 |
| 5,071,489 | A | 12/1991 | Silvenis et al. | 15/231 X |
| 5,094,559 | A | 3/1992 | Rivera et al. | 401/132 |
| 5,095,574 | A | 3/1992 | Khanzadian | 15/118 |
| 5,435,852 | A | 7/1995 | Robinson | 134/6 |
| 5,455,980 | A | 10/1995 | Buchanan | 15/228 |
| 5,477,582 | A | 12/1995 | Yamashita | 15/231 |
| 5,522,648 | A | 6/1996 | Wilen | 300/21 |
| 5,525,397 | A | 6/1996 | Shizuno et al. | 428/138 |
| 5,553,344 | A | 9/1996 | Rosenkrantz | 15/104.002 |
| 5,596,787 | A | 1/1997 | Stevens et al. | 15/228 X |
| 5,603,138 | A | 2/1997 | Bonis | 15/220.1 |
| 5,639,532 | A | 6/1997 | Wells | 428/95 |
| 5,878,459 | A | 3/1999 | McParland | 15/144.1 X |
| 6,119,298 | A | 9/2000 | Kenmochi | 15/231 |

* cited by examiner

FIG-7
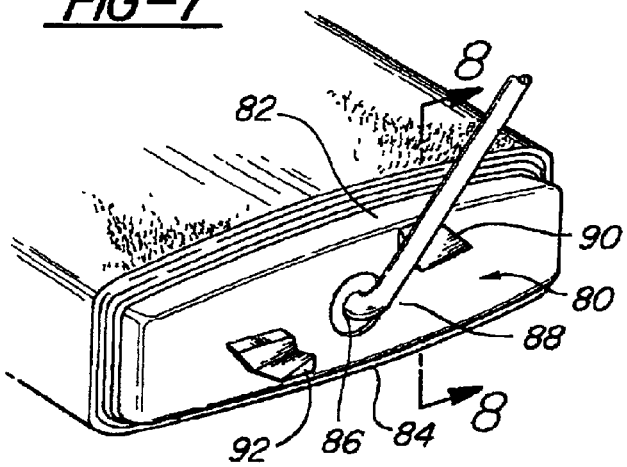
FIG-8
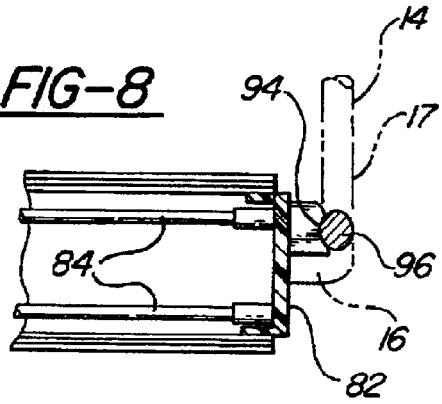
FIG-9
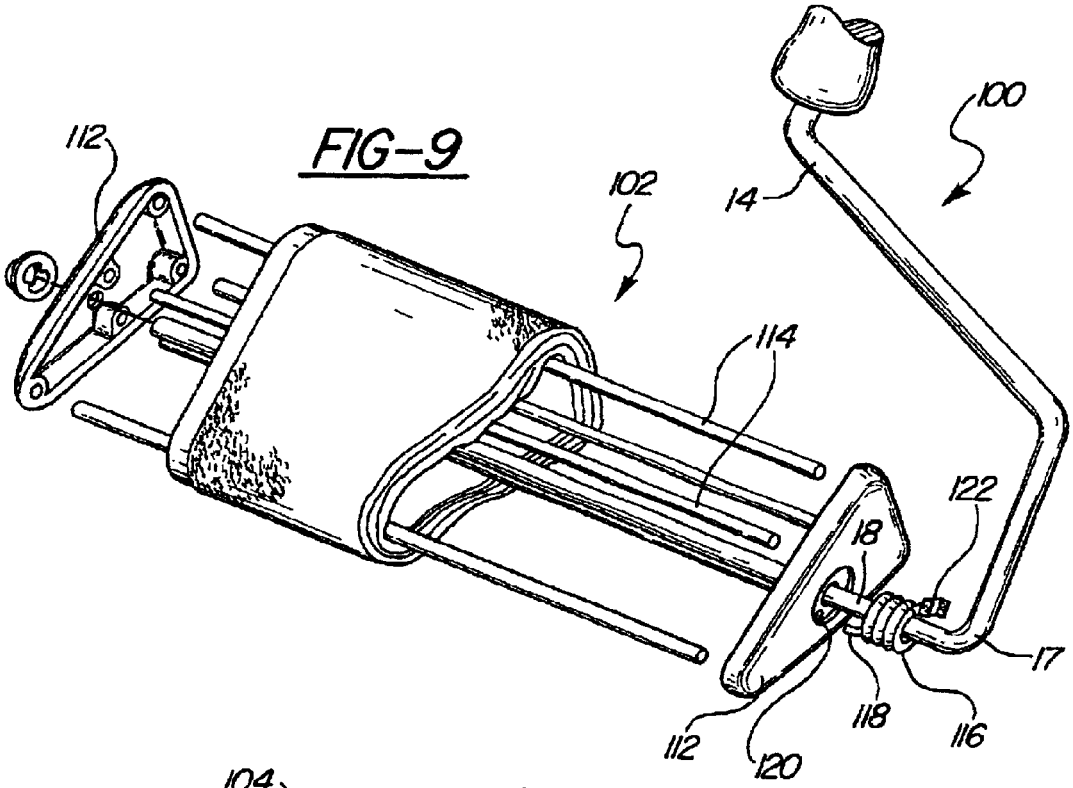
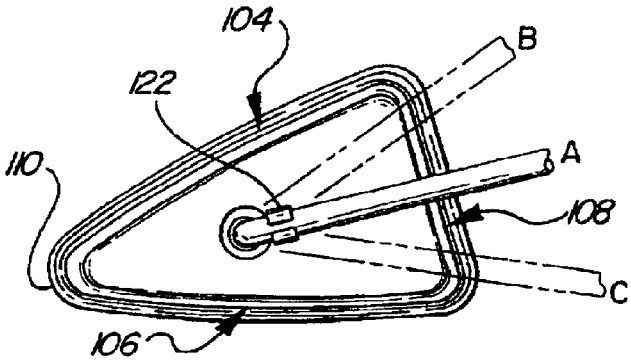
FIG-10

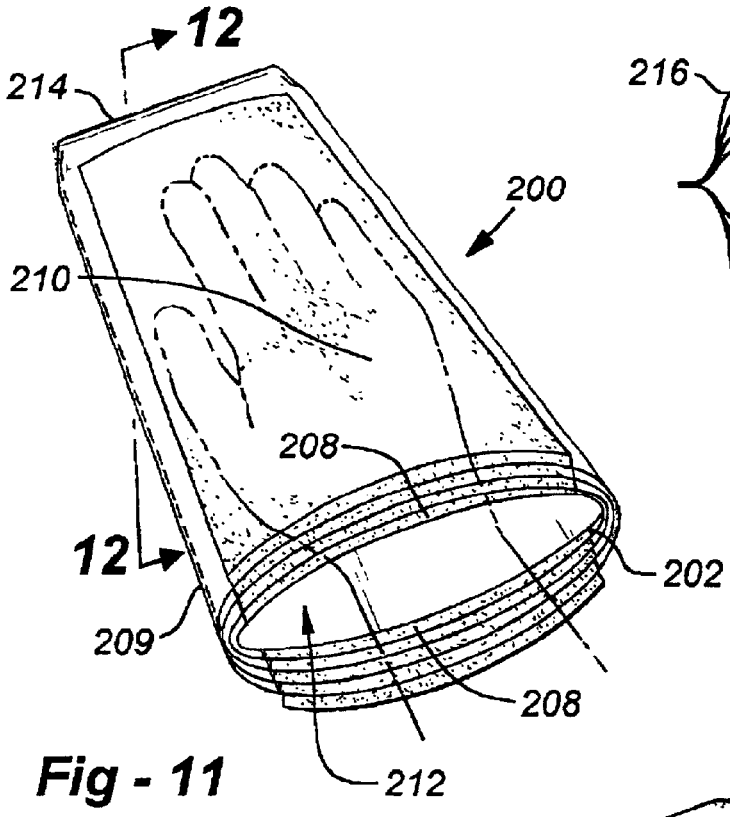
Fig - 11
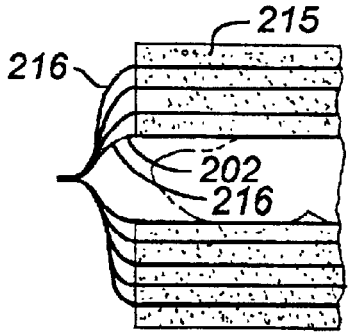
Fig - 12
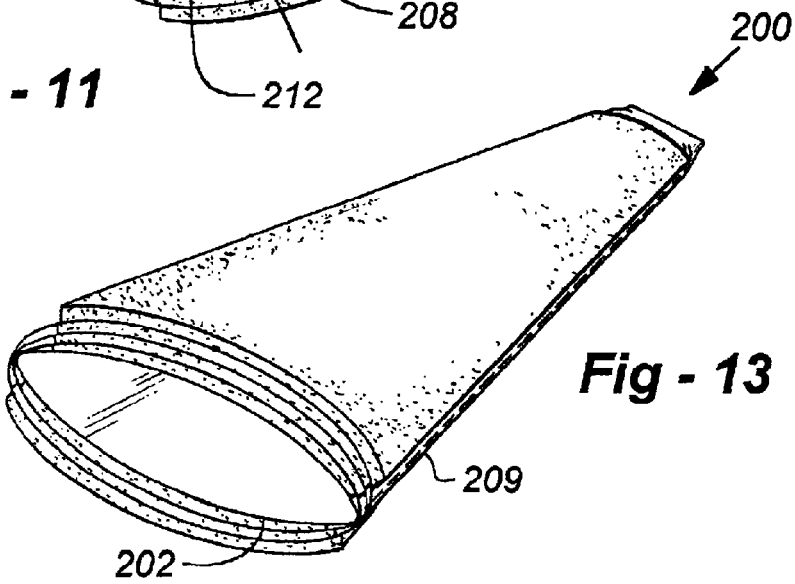
Fig - 13
Fig - 14
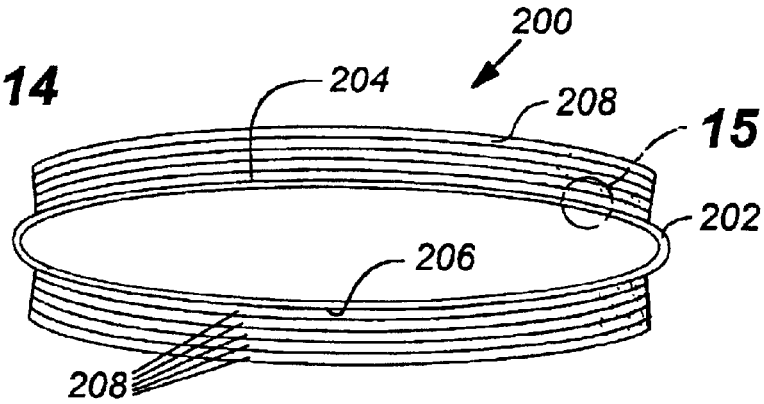

CLEANING TOOL WITH REMOVABLE CLEANING SHEETS

REFERENCE TO RELATED APPLICATIONS

This application is a continuation-in-part of U.S. patent application Ser. No. 09/979,415, filed Nov. 14, 2001 now abandoned which is the U.S. national phase of PCT/US99/12945, filed Jun. 11, 1999; and is a continuation-in-part of U.S. patent application Ser. No. 09/602,189, filed Jun. 12, 2000, now U.S. Pat. No. 6,405,403, which is a continuation-in part of U.S. patent application Ser. No. 09/094,551, filed Jun. 12, 1998, now U.S. Pat. No. 6,298,517; and claims priority from U.S. provisional patent application Ser. No. 60/260,969, filed Jan. 10, 2001, and U.S. provisional patent application Ser. No. 60/311,463, filed Aug. 11, 2001; the entire contents of all of which are incorporated herein by reference.

FIELD OF THE INVENTION

This invention relates generally to tools for cleaning surfaces such as counters, mirrors, windows, floors, walls, ceilings, pet coats, and furniture surfaces and, more specifically, to a cleaning tool having removable cleaning sheets.

BACKGROUND OF THE INVENTION

Surfaces such as counters and floors are most aesthetically pleasing and safe when they are clean, dry, and free of dirt or debris. Unfortunately, surfaces typically become soiled rapidly due to environmental contaminants such as dust and due to the deposit of dirt and debris and liquids by people, machines, and pets. Numerous devices and methods have been developed for returning a surface to a clean and dry condition and people are constantly striving to develop better methods. Sweeping or vacuuming works well for removing loose dirt and debris, and mopping works well for removing liquids and certain debris which is lightly adhered to a surface such as a tile or wood floor. Serious stains and sticky dirt and debris may require scrubbing and the use of strong chemicals. These methods work well to thoroughly clean a surface such as a floor but all suffer from the drawback of being time consuming and difficult. In addition, it is often not necessary to thoroughly clean the surface to return it to a clean and dry condition. For example, a small spill or localized deposit of dirt and debris does not necessitate a vacuuming or mopping of the entire floor. However, they still require the use of the same equipment. For example, to vacuum even a small area requires a person to locate the vacuum cleaner, uncoil and plug in a power cord, select the correct attachments, vacuum up the dirt and debris, and reverse the process to put the vacuum cleaner back away. Likewise, mopping even in a small area requires the use of a mop and bucket. Either approach is time consuming. Alternatively, a person may take a towel or disposable cleaning sheets such as a paper towel and get down on their knees and clean the localized area. This is also undesirable for many people since it requires them to stoop down and contact the floor with their hands. Some persons may find this uncomfortable or, due to physical limitations, impossible. Therefore, there is a need for improved devices and methods for simple cleaning duties such as removing localized areas of dirt and debris or lightly cleaning a surface. Previous attempts to address this need include small hand held rechargable vacuum cleaners and improved self-wringing mops. However, these solutions do not adequately address the needs of typical homeowners. For example, if a homeowners has a small spill of liquid on a floor, they may not wish to use even the best of self-wringing mops since mops should be thoroughly rinsed after use to prevent contamination of the mop. The use of a paper towel may also be inadequate since it requires getting down on one's hands and knees to use.

Another example of a light cleaning job is where the homeowner wishes to remove a light coating of dust or debris from a window or mirror. Use of a bucket and sponge or rag is unnecessarily involved since what is really needed is a light cleaning of the surface. A homeowner may wish to just return the surface to its optimal appearance without unnecessary steps. Therefore, there is a need for a simple device to quickly and easily clean a variety of surfaces.

SUMMARY OF THE INVENTION

The present invention provides a refill for a mop of the type having a mop head with a lower surface and an opposed upper surface interconnected by a leading and a trailing edge. The mop head has gripping means provided on the upper surface for retaining a cleaning sheet on the mop head. The refill included a base layer with a front edge and an opposed rear edge with a midportion therebetween. The base layer is configured to be wrapped about the mop head with the midportion adjacent to the lower surface of the mop head and the front and rear edges wrapping onto the upper surface of the mop head so as to be retained by the gripping means. A plurality of cleaning sheets are removable supported on the midportion of the base layer in a stack configuration. Each of the sheets has an outward face for cleaning and an opposed inward face. The outward face of each of the sheets is configured to contact the surface to be cleaned and thereby become soiled. When the outward face of the outermost sheet becomes soiled, the sheet may be peeled away to expose a non-soiled sheet. In some embodiments of the present invention, the cleaning sheets are each a non-woven material, and a backing layer, are both provided for each of the cleaning sheets. The sheets may be coextensive and joined at their edges so that the joined edges may be gripped by the gripping means on the upper side of the mop.

The present invention also provides a cleaning mitt having a plurality of coextensive and mitt-shaped cleaning sheets disposed in a stacked configuration. Each cleaning sheet has a central portion bounded by an outer perimeter, with the outer perimeter having a first edge. The perimeters of the cleaning sheets are bonded to each other, except along the first edge, such that the plurality of cleaning sheets are retained in the stacked configuration. The first edges defines an opening such that a hand may be passed between adjacent cleaning sheets to a position between the central portions of the adjacent cleaning sheets. A portion of each of the cleaning sheets is separable from the stack of cleaning sheets such that when an outermost sheet becomes soiled, the separable portion of the cleaning sheets may be peeled away to expose a portion of the non-soiled sheet.

BRIEF DESCRIPTION OF THE DRAWINGS

FIG. 7 is a perspective view of a portion of a mop according to the present invention illustrating a preferred pivot range limiter;

FIG. 8 is a cross-sectional view of a portion of the mop of FIG. 7 taken along line 8—8;

FIG. 9 is an exploded perspective view of a third embodiment of a mop according to the present invention;

FIG. 10 is an end view of the mop of FIG. 9;

FIG. 11 is a perspective view of a cleaning tool according to a fourth embodiment of the present invention wherein a core of the cleaning tool is sized to accept a hand;

FIG. 12 is a cross-sectional view of the cleaning tool of FIG. 11 taken along lines 12—12;

FIG. 13 is an additional perspective view of the cleaning tool of FIG. 11 showing perforations along an edge thereof;

FIG. 14 is an end view of the cleaning tool of FIGS. 11–13 showing the opening for insertion of a hand;

DETAILED DESCRIPTION OF THE PREFERRED EMBODIMENTS

Figure 1:
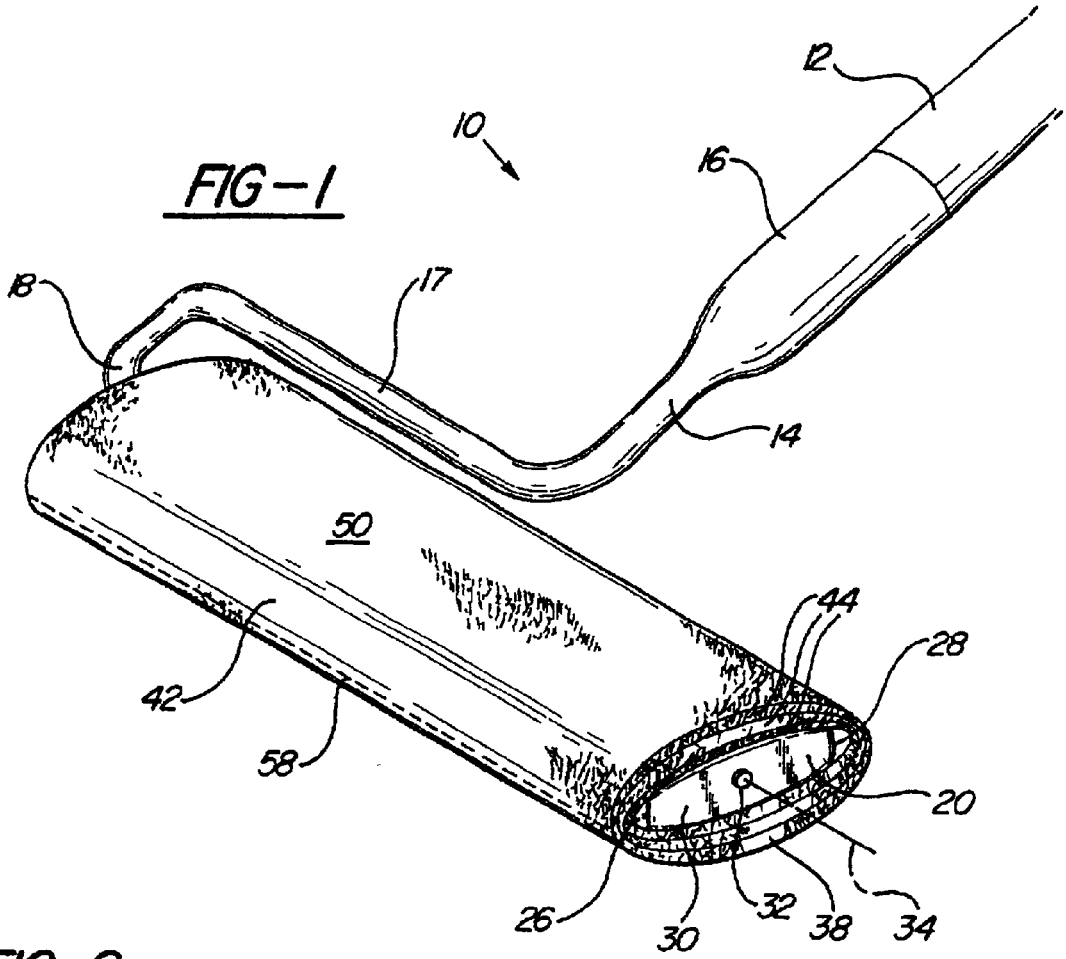
FIG. 1 is a perspective view of the one embodiment a mop according to the present invention.
Figure 2:
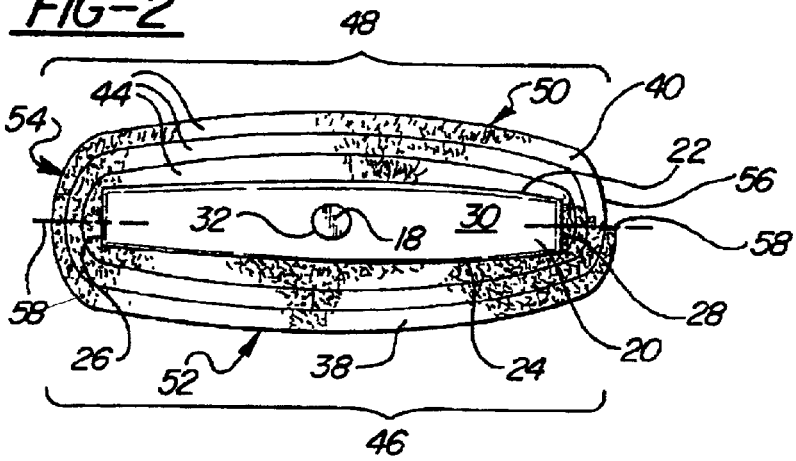
FIG. 2 is an end view of the mop of FIG. 1.

Referring to FIGS. 1 and 2, a mop according to the present invention is generally shown at 10. The mop 10 included and elongated handle 12 for a user to grip the mop 10 and a mop head 20 which is interconnected with the mop handle 12 by a mop head mount 14. The elongated handle 12 is detachable from the mount 14. Other sizes and shapes of handles may be substituted, such as an extension pole to allow use of the mop to clean a surface that is hard to reach. The mop 10 can also be used without the elongated handle 12, with the user gripping the mop head mount 14 which acts as a short handle. The mop head 20 has a top side which is defined as an upper surface 22, and a bottom side which is defined as a lower surface 24. The upper and lower surfaces 22, 24 are interconnected at the front of the mop head 20 by a leading edge 26 and at the back of the mop head by a trailing edge 28. The side of the mop head are defined by a pair of ends 30.

An elongated web 38 of cleaning material 40 is wrapped about the mop head 20 so as to form an oblate roll 42 with a plurality of layers 44. The roll 42 of material 40 defines a first plurality of cleaning sheets 46 supported on the lower surface 24 of the mop head 20 and a second plurality of cleaning sheets 48 supported on the upper surface 22 of the mop head 20. The cleaning sheets 46, 48 are each removable supported on the respective surfaces 22, 24 in stacked configurations. While in the preferred embodiment the cleaning sheets 46, 48 are defined by a web 38 of cleaning material 40 wrapped about the mop head 20, the cleaning sheets 46, 48 may also be individual sheets which are supported on one or both surfaces 22, 24 of the mop head 20 in a stacked configuration. For clarity of description, the roll 42 is defined as having an upper surface 50 on the top of the roll 42, a lower surface 52 on the bottom of the roll 42, a leading edge 54 interconnecting the upper 50 and lower 52 surfaces at the front of the roll 42, and a trailing edge 56 interconnecting the upper 50 and lower 52 surfaces at the rear of the roll 42. The upper 50 and lower 52 surfaces and the leading 54 and trailing 56 edges correspond to the like named portions of the mop head 20. The upper 50 and lower 52 surfaces of the roll 42 are preferably curved.

In the illustrated embodiment, the web 38 of material 40 includes perforations 58 to allow a portion of the web 38 of material 40 to be removed from the remainder of the web 38. Most preferably, the perforations 58 are located on the leading 54 and trailing 56 edges of the roll 42 so that a portion of the web 38 forming the upper 50 or lower 52 surface may be removed in its entirety, thereby exposing a fresh surface. The perforations 58 may either be cut after the roll 42 is formed or the material 40 may be perforated prior to forming the roll 42. By "perforations," it is meant that the web has areas designed to tear or separate. This includes the use of a weakened area, a series of small cuts, or one or more large slits.

The roll 42 of cleaning material 40 is preferably configured so as to allow the use of refills. Roll 42 is formed such that it may be removed from the mop head 20 and replaced with a new roll 42. The roll 42 may be formed with some type of core, such as a cardboard tube, or as a coreless roll. Either way, the roll 42 is configured to be placed over mop head 20. Once the roll 42 of cleaning material 40 is used up, a new roll 42 can be placed on the mop head 20.

The cleaning material 40 or individual cleaning sheets have an-outward face 60 for cleaning and an opposed inward face 62. In using the mop 10 of the illustrated embodiment, the mop 10 is oriented such that the lower surface 52 of the mop head 20 faces a surface to be cleaned, such as a floor. The outward face 60 of the lower surface 52 of the roll 42 is brought in contact with the floor, thereby becoming soiled. When the used portion of the roll 42 becomes sufficiently soiled as to require replacement, that portion of the roll 42 is removed by peeling off the material 40 and tearing along a perforation 58. Thereby, an unsoiled portion of the material is exposed for cleaning. If using the embodiment with a plurality of individual sheets 46, 48 not in a roll 42, the outermost sheet may be peeled off once it becomes soiled.

The illustrated mop head 20 is an elongated piece of material such as plastic or metal. In plan view, the mop head 20 is generally rectangular with a side-to-side width (the distance between the ends 30) greater than its front-to-back length (the distance between the leading edge 26 and trailing edge 28). In one preferred embodiment, a mop head 20 has a side-to-side width of approximately 13 inches and a front-to-back length of approximately four inches, though other sizes and shapes are certainly possible.

Referring to FIG. 2, the mop head 20 is generally rectangular in cross-section with a thickness (the distance between the upper surface 22 and the lower surface 24) less than its front-to-back length. In one preferred embodiment, the mop head 20 has a thickness of approximately one inch. As shown, the upper 22 and lower 24 surfaces are preferably slightly convexly curved in cross-section, but alternatively may be flat or greatly curved.

The mop head 20 has an axial bore 32 which passes widthwise through the mop head 20, passing through both ends 30. The axial bore 32 defines a support axis 34 for the mop head 20. The mop head mount 14 is generally hook shaped and has a handle mounting portion 16 at one of its ends, and a perpendicular support portion 18 at its other end. The mounting portion 16 and support portion 18 are interconnected by an interconnection portion 17 that meets the support portion 18 at right angles and curves up to meet the mounting portion 16. The support portion 18 is disposed in the axial bore 32 of the mop head 20, thereby interconnecting the mop head 20 with the mop handle 12. As will be clear to one of skill in the art, a mop head mount 14 of this type is similar to the mounting arrangement used with paint rollers and the like and may be implemented in a number of ways. In an alternative embodiment, the elongated handle 12 is not used. Instead, the mounting portion 16 of the mount 14 acts as a handle and is gripped by a user.

Preferably, the mop head 20 is pivotally interconnected with the mop handle 12 by the mop head mount 14. In the illustrated embodiment, the support portion 18 of the mop head mount 14 is rotatable within the axial bore 32 of the mop head 20 thereby allowing the mop head 20 to pivot about the support axis 34 of the mop head. As illustrated, the lower surface 24 of the mop head 20 is positioned on the bottom side of the mop head 20 so as to face a horizontal surface to be cleaned, such as a floor. Because the mop head 20 and the mop handle 12 are pivotally interconnected, the mop head 20 can be rotated 180 degrees relative to the mop handle 12 thereby repositioning the lower surface 24 on the top side of the mop head 20 and the upper surface 22 on the bottom side of the mop head 20. By rotating the mop head 20, both the upper 22 and lower 24 surfaces of the roll 42 of material 40 can be used to clean and will become soiled.

As discussed above, the roll 42 of cleaning material 40 may be formed with some type of core. In an alternative embodiment, the mop head 20 comprises a pair of end supports which interconnects with the core of the roll 42 of cleaning material 40, thereby supporting the roll 42. In this case, the mop head does not extend through the center of the roll but instead supports the roll at its ends. This is similar to the way in which some types of paper towel holders support a roll of paper towels, by engaging the ends of a central core. This is a particularly simple embodiment of the present invention and is desirable for some applications. In this embodiment, the core of the roll 42 acts as part of the mop head 20 with the web 38 of cleaning material 40 wrapped thereabout.

Other alternative mop head designs also fall within the present invention. As discussed previously, a first plurality of cleaning sheets may be supported in a stacked configuration on only one surface of a mop head. This simpler embodiment of the mop head may be of a variety of shapes as long as it provides a surface for supporting a stack of cleaning sheets. Alternatively, a plurality of cleaning sheets may be stacked on more than one surface of the mop head. For example, with a rectangular cross section mop head, a first and a second plurality of cleaning sheets may be separately supported on the upper and lower surfaces of the mop head. This differs from the earlier discussed embodiment in that the first and second plurality of cleaning sheets are each individual stacks rather than being formed as part of a roll. As another example, the mop head may be triangular in cross section, having three surfaces, an upper surface, a lower surface, and a third surface. Individual stacks of cleaning sheets may be supported on one or more of these surfaces.

The web 38 of cleaning material 40 is wrapped about the mop head 20 so as to form an oblate roll 42. As used herein, "oblate roll" refers to a variety of shapes wherein the distance between the upper 22 and lower 24 surfaces of the roll 42 is less than the distance between the leading edge 54 and trailing edge 56 of the roll. The oblate roll 42 may be ellipsoidal, oval, or football-shaped in cross-section so as to present a curved upper 22 and lower 24 surface. Alternatively, the oblate roll 42 may also be a roll that has a flat upper 22 and lower surface 24. However, it is preferred that the upper 22 and lower 24 surfaces are curved. The oblate shape of the roll 42 is important to the function of the mop 10. Because the roll 42 is not round, the oblate roll 42 resists rolling across a surface to be cleaned as the contact is moved across the surface. Instead, the lower surface 24 of the roll 42 tends to remain in contact with the surface to be cleaned as the mop head 20 is moved across the surface. The mop head 20 will rotate slightly as it is moved back and forth across the surface to be cleaned but resists clipping to expose the upper surface 22 due to the flattened shape of the oblate roll 42.

The web 38 of cleaning material 40 which forms the oblate roll 42 may be of several types depending upon the application of the mop 10. In FIGS. 1 and 2, the cleaning material 40 disposed on the mop head 20 is a single layer of bibulous material such as a non-woven material or a paper towel-like material. Sponge-like and woven materials are also possible. By "bibulous" it is meant that the cleaning material 40 is absorbent and is capable of being imbibed with a cleaning solution. In the simplest embodiment, the cleaning material 40 is a paper towel-like material which can be used to absorb small spills. The material 40 can also be sprayed with a cleaning solution and then brought into contact with a soiled region for cleaning the soiled region. Alternatively, the cleaning material 40 is a non-woven material that is pretreated with a substance such as mineral oil or lemon oil. The cleaning material 40 may also be pretreated with other substances such as a disinfectant. The oil treated embodiment is especially useful for picking up dust such as from a hardwood floor. The mineral oil or lemon oil allows the mop 10 to pick up and retain dust as it comes into contact with the cleaning material 40. This provides an especially easy and quick way to make a hardwood floor appear freshly cleaned. The cleaning material 40 may be embossed or multi-dimensional to give the outward surface texture so as to improve the cleaning ability of the cleaning material 40.

The layers 44 of the cleaning material 40 forming the oblate roll 42 may be retained in their stacked configuration in a variety of ways. Many non-woven and paper towel-like materials actually cling to themselves and therefore the outermost layer would tend to stay in place on the roll 42 until manually removed by the user. Alternatively, and preferably, the inward face 62 of each of the layers 44 of cleaning material 40 is treated with an adhesive 64 for retaining the layers 44 in place. This causes the inward face 62 of one layer 44 to stick to the outward face 60 of an adjacent layer 44. As will be clear to one of skill in the art, the adhesive 64 is chosen and applied so as to allow easy releasability of a soiled portion of the cleaning material 40 from the remainder of the roll 42. Adhesive may be applied to the inward face 62 of the cleaning material 40 in a pattern or the adhesive 64 may be flood coated on the inward face 62 of the cleaning material 40. Alternatively, only a portion of the inward face 62 may be adhesive coated. For example, it may be desirable to leave one or more of the edges of the material 40 uncoated to make removal easier.

Figure 3:
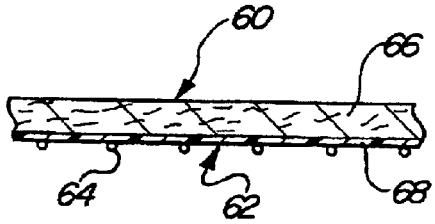
FIG. 3 is a cross-sectional view a portion of one embodiment of a cleaning sheet for use with a mop according to the present invention.

Referring now to FIG. 3, a portion of a preferred embodiment of the cleaning material 40 is shown in cross section. In this embodiment, the cleaning material 40 includes a bibulous layer 66, such as a non-woven or paper towel-like material, that defines the outward face 60 of the cleaning material 40. The bibulous layer 66 may also be a thin sponge-like material or a woven material. The cleaning material 40 also has a moisture barrier layer 68 that is operative to prevent transport of liquid from the bibulous layer 66 of one sheet 46, 48 to the bibulous layer 66 of an adjacent sheet 46, 48 when the sheets are in a stacked configuration. Preferably, the moisture barrier layer 68 also supports and strengthens the bibulous layer 66. The moisture barrier layer 68 defines the inward face 62 of the cleaning material 40 and is preferably pattern coated with adhesive 64 for retaining one layer 44 of cleaning material 40 in place on an adjacent layer 44 of cleaning material 40. The moisture barrier layer 68 may be any of a variety of thin plastic materials or may be formed of other material which prevents the transport of moisture therethrough. The moisture barrier layer 68 may also be formed by coating the bibulous layer 66 with a moisture barrier substance. Adhesive 64 may be either pattern coated or flood coated on the inward face 62 of the moisture barrier layer 68. Alternatively, where the moisture barrier layer 68 is a coating on the bibulous layer 66, the moisture barrier layer 68 may be naturally tacky, thereby eliminating the need for additional adhesive 64. As another alternative, the cleaning material 40 may be a single layer material with inherent moisture barrier or moisture resistant characteristics.

The use of a multiple layer cleaning material 40, as shown in FIG. 3, allows for a variety of combinations of materials and treatments to suit a variety of applications. For the simplest arrangement, the bibulous layer 66 is simply an absorbent sheet which can be used for light cleaning duties such as soaking up spills. The moisture barrier layer 66 prevents the spill from wetting more than the outermost layer of the cleaning material 40. Once the bibulous layer 66 is soiled, or has absorbed its capacity of liquid, the user may peel the outermost layer of the cleaning material 40 from the remainder of the roll 42 thereby exposing a new bibulous layer 66. The mop head 20 may also be rotated to expose the upper surface 50 of the roll 42 for further cleaning. Alternatively, the bibulous layer 66 may be pretreated with a liquid such as dusting oils or cleaning solutions. Because the bibulous layer 66 is sandwiched between adjacent moisture barrier layers 68, the dusting oil or cleaning solution is prevented from evaporating from all but the outermost layer of the roll. Therefore, when a user is ready to use the mop, the user first peels off the outermost layer to expose a fresh bibulous layer 66 that is pretreated with a dusting oil or cleaning solution. Alternatively, the mop 10 is provided with a cover configured to cover and moisture seal the mop head 20 when it is not in use. The cover prevents evaporation from the outermost layer of the roll 42 so that the mop 10 remains ready to use.

Figure 4:
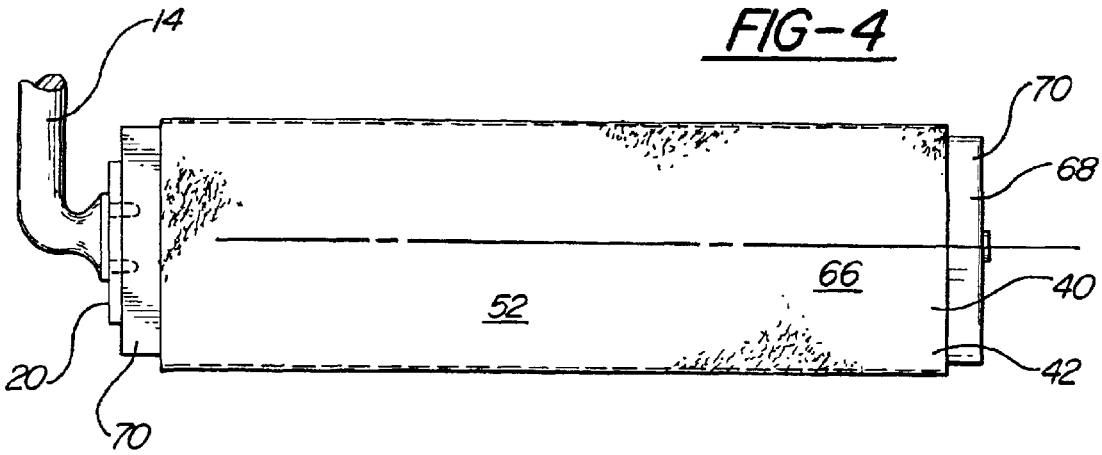
FIG. 4 is a bottom view of a second embodiment of a mop according to the present invention.

Referring now to FIG. 4, a second embodiment of a mop 10 according to the present invention is shown. This embodiment differs from the embodiment of FIG. 1 in that the cleaning material 40 consists of two layers, a bibulous layer 66 and a moisture barrier layer 68, as in FIG. 3. As shown, the moisture barrier layer 68 is wider than the bibulous layer 66 leaving a projecting portion 70 which projects beyond each side of the bibulous layer 66 adjacent the ends 30 of the mop head 20. These projecting portions 70 serve a couple of purposes. First, the projecting portions 70 do not become soiled during the cleaning process because they are not absorbent or treated with cleaning solution. Therefore, the projecting portions 70 provide a non-soiled area which a user can grip to help remove the outermost layer from a roll 42 of cleaning material 40. Secondly, the inward face 62 of the moisture barrier layer 68 is treated with an adhesive causing the projecting portions 70 to stick to the adjacent projecting portions 70 in the adjacent layers 44 of the roll 42. The projecting portions could also be interconnected by heat bonding, sonic welding, or mechanical bonding. This further seals in the unsoiled bibulous layers 66 to prevent their premature contamination. The projecting portions 70 prevent liquid and dirt from contaminating the ends of the unexposed bibulous layers 66 by sealing off those ends. Preferably, this allows the roll 42 of cleaning material 40 to be held under a faucet or dipped in a bucket thereby wetting the outermost bibulous layer 66 without wetting the unexposed layers. Alternatively, the moisture barrier layer 68 does not project beyond the bibulous layer 66 or projects only at one side.

Figure 5:
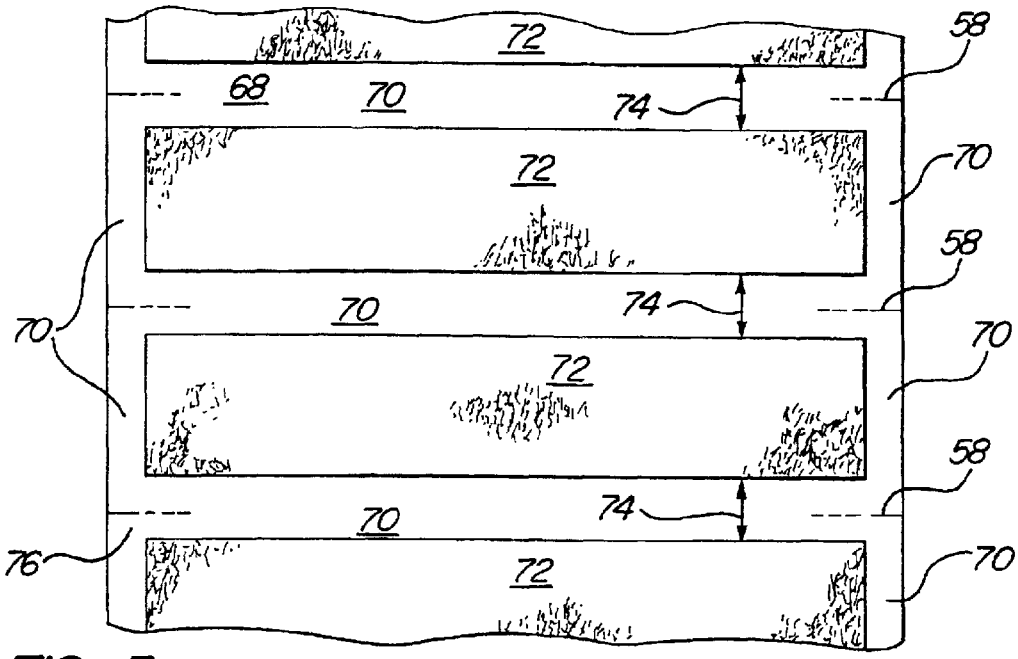
FIG. 5 is a plan view of a portion of one embodiment of a web of cleaning material for use with a mop according to the present invention.
Figure 6:
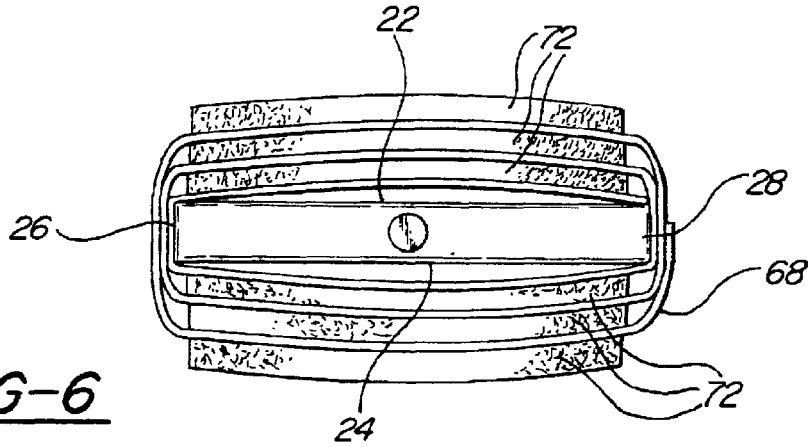
FIG. 6 is an end view of a mop head with a web of cleaning material as shown in FIG. 5 wrapped about the mop head.

Referring now to FIGS. 5 and 6, another alternative embodiment of the cleaning-material 40 is shown. In this embodiment, the web 38 of cleaning material 40 includes a web 38 of moisture barrier material 68 that acts as both a support layer and a moisture barrier layer. A plurality of bibulous cleaning pads 72 are supported on the support layer along its length leaving a gap 74 between each cleaning pad 72. Therefore, the support layer forms a continuous web 38 with the bibulous pads 72 placed at intervals along the support layer. As shown in FIG. 6, the web 38 of cleaning materials 40 is then wrapped about the mop head 20 so as to position the bibulous pads 72 on the upper 22 and lower 24 surfaces of the mop head 20. The gaps 74 between the pads 72 are positioned adjacent the leading 26 trailing 28 edges of the mop head 20. As will be clear to one of skill in the art, the gaps 74 between the bibulous pads 72 preferably vary in dimension so as to allow the bibulous pads 72 to remain in a stacked configuration when the web 38 of cleaning material 40 is wrapped about the mop head 20. The outer layers of the oblate roll 42 must have larger gaps 74 or larger bibulous pads 72 so that the bibulous pads 72 continue to be aligned as the roll 42 is formed. Preferably, the support layer is perforated in each of the gaps 74 so as to allow removal of a portion of the support layer including one bibulous pad 72 from the roll 42 of cleaning material 40.

As can be seen, this configuration of the cleaning material 40 creates a projecting portion 70 that extends around the entire perimeter of each bibulous pad 72, thereby forming a perimeter margin 76. Therefore, the support/moisture barrier layer 68 extends not only beyond each bibulous pad 72 adjacent the ends 30 of the mop head 20, but also beyond each bibulous pad 72 adjacent the leading 26 and trailing 28 edges of the mop head 20. By adhesive coating the inward face 62 of the support/moisture barrier layer 68, each perimeter margin 76 can be bonded to an adjacent perimeter margin 76 thereby totally encapsulating each unexposed bibulous pad 72. Preferably, this allows the mop head 20, including the roll 42 of cleaning material 40, to be submerged in a bucket of cleaning solution, with only the outermost bibulous pads 72 being exposed to the cleaning solution. Like the configuration in FIG. 4, the configuration of FIG. 6 provides clean portions of the cleaning material 40 for a user to grip when removing an outermost soiled layer. The configuration in FIG. 6 is especially advantageous in that a portion of the cleaning material 40 adjacent each perforation 58 does not become soiled in the cleaning process, making removal a more pleasant task.

In another embodiment, some or all of the outward face 60 of the perimeter margins 76 may be coated with a light adhesive so that dirt and debris tends to stick to the perimeter margin 76. This allows the perimeter margin to pick up dirt and debris which is pushed ahead of or pulled behind the bibulous pad 72 during the cleaning process thereby retaining the dirt or debris.

In alternative embodiments, the bibulous pads 72 may be positioned and/or sized such that they are flush with one or both sides of the moisture barrier layer 68, thereby eliminating all or part of the projecting portion 70. Also, a gap 74 is not required between each pad 72. Two pads 72 may be flush to one another followed with a gap 74 and then two more flush pads 72. Or, all pads 72 may be flush with no gaps 74. In these configurations, perforations may be placed after each pad 72, only in the gaps 74, or only between flush pads 72.

The bibulous pads 72 or the bibulous layers 66 of the above-discussed embodiments may be pretreated with a variety of substances. This includes dusting oils and cleaning solutions. As one example, pads 72 or the layer 66 may be pretreated with a dry antibacterial substance which becomes activated when the pad 72 or layer 66 is wetted. All pads 72 or the entire bibulous layer 66 may be treated with one substance such as the dusting oil or cleaning solution. Alternatively, different portions of the bibulous layer 66 or different bibulous pads 72 may be treated with different substances. As one alternative, the embodiment of the mop 10 having bibulous pads 72 separated by gaps 74 may have pads 72 treated with one substance alternate with pads 72 treated with a second substance. The first substance may be a solvent while the second substance may be a neutralizer. The pads located on the upper surface point to the mop head 20 would be treated with the first substance while the pads 72 located on the lower surface 24 of the mop head 20 would be treated with the second substance. Therefore, the user would first use the pads 72 located on one of the surfaces to apply the first substance, and then would rotate the mop head 20 180 degrees to use the pads 72 located on the other surface. As another example, the pads 72 located on the lower surface of the mop head 20 may be treated with a cleaning solution while the pads 72 located on the upper surface 22 of the mop head is not pretreated and therefore merely absorbent. The user would use the pads 72 located on the lower surface 24 to apply cleaning solution to the surface to be cleaned and would then rotate the mop head 20 and use the pad 72 located on the upper surface 24 to absorb the cleaning solution from the surface to be cleaned. Many other variations on this approach fall within the present invention.

As shown in FIG. 6, each of the bibulous pads 72 is disposed only on either the upper 22 or lower 24 surface of the mop head 20 and does not extend onto the leading 26 or trailing 28 edges. However, in an alternative preferred embodiment, the bibulous pads 72 extend across the entire upper 22 or lower 24 surface and wrap up onto both the leading 26 and trailing 28 edge of the mop head 20 thereby leaving only a small gap 74 between each bibulous pad 72. This embodiment increases the usable amount of cleaning material 40 and also takes advantage of the natural curvature of the outer surface of the roll 42. As the mop head 20 is moved back and forth across the cleaning surface, the portion of the cleaning pad 72 in contact with the cleaning surface will be changed as the mop head 20 pivots slightly front to back. As the cleaning pad 72 pivots front to back, different portions of the curved surface come into and out of contact with the cleaning surface. Portions of the cleaning pad 72 adjacent the leading 26 and trailing 28 edges thereby are able to lift dirt and debris out of contact with the floor as the cleaning direction is reversed.

Referring now to FIGS. 7 and 8, a portion of an alternative preferred embodiment of a mop head 80 is shown. In this embodiment, the mop head 80 is formed with a pair of end caps 82 interconnected by a series of metal rods 84 similar to the construction of a paint roller head. However, unlike a paint roller head, the mop head 80 of the present invention is not circular in cross section but rather is somewhat flattened. The end caps 82 interconnect with the mop head mount 14. Each end cap 82 has a hole 86 therethrough defining the support axis 88 of the mop head 20. The mop head mount 14 is disposed in the holes 86 thereby pivotally supporting the mop head 20. During the cleaning process, it is desirable that the mop head 80 not be able to rotate beyond a certain range. The preferred range may vary but it is desirable that the mop head 80 not be allowed to rotate such that the upper 22 and lower 24 surfaces trade positions. To rotate the mop head 180 degrees to expose the other surface, the user will first need to manually rotate the mop head 80. As will be clear to one of skill in the art, selectively limiting the range of pivotal motion may be accomplished in many ways. One approach is shown in FIGS. 7 and 8. A first travel limiter 90 and a second travel limiter 92 are disposed on one end cap 82 and extend therefrom. These travel limiters 90, 92 engage the mop head mount 14 as it pivots and approaches their position. The limiters 90, 92 may be as simple as plastic tabs extending outwardly from the end caps 82. In this case, when the user is ready to rotate the mop head 180 degrees, the user merely flexes the mop head mount 14 sufficiently to clear one of the limiters 90, 92 and rotates the mop head mount 14 past the stop. At times, it may be desirable to lock the mop head mount 14 at one position relative to the mop head 80 so that the mop head 80 is not allowed to rotate relative to the mop handle 12. This may also be accomplished in a number of ways. In the embodiment shown in FIGS. 7 and 8, the first travel limiter 90 includes a recess 94 in its outward extending face 96. The mop head mount 14 may be flexed so as to pass partially over the limiter 90 and then released so as to engage the recess 94 in the outward extending face 96 of the limiter 90. The mop 10 may then be used to clean a surface without worrying about the mop head 80 rotating. This may be especially desirable when cleaning a surface such as a wall.

The pivotal interconnection between the mop head 20 and the handle 12 may be designed to include a predetermined amount of friction thereby preventing easy rotation of the mop head 20. Friction in the pivotal interconnection will help to prevent bouncing, jumping, or vibrating of the mop head 20 as it is wiped across a surface. Alternatively, the amount of friction may be adjustable.

Referring now to FIGS. 9 and 10, a third embodiment of a mop 100 according to the present invention is shown. This embodiment differs from the earlier embodiments mainly in the cross sectional shape of the mop head 102. In this embodiment, the mop head 102 has a triangular cross section. The triangle has two long sides and one shorter side. The long sides define an upper surface 104 and a lower surface 106 of the mop head 102 and the shorter side defines a back surface 108. The sides are interconnected by radiused corners. The radiused corner which joins the upper 104 and lower 106 surfaces defines the leading edge 110 of the mop head 102 and the back surface 108 defines the trailing edge. As discussed earlier, the mop head 102 is formed similar to a paint roller having a pair of end caps 112 interconnected by a plurality of metal rods 114. A roll of cleaning material is wrapped about the metal rods 114. A spring 116 is positioned around the support portion 18 of the mop head mount 14 and is designed to bias the mop head 102 to a predetermined neutral position relative to the mop handle. The spring 116 wraps around the support portion 18 of the mop head mount 14 and is positioned between one of the end caps 112 of the mop head 102 and the interconnecting portion 17 of the mop head mount 14. One end of the spring 116 is a tab 118 which engages a hole 120 in the end cap 112. The other end of the spring 116 includes a clip 122 for clipping onto the interconnecting portion 17 of the mop head mount 14. When the spring 116 is in its unstressed position, the mop head 102 is in the neutral position relative to the mop handle. This neutral position is indicated as A in FIG. 10. As the mop head mount 14 is rotated in either direction away from the neutral position, the spring 116 begins to resist the movement. However, the spring rate is chosen so as to allow the mop handle to move in either direction sufficiently to allow use of the mop head 102 on a cleaning surface. For example, in FIG. 10 the position marked as B is the position in which the mop head mount 14 would be located when a user wishes to use the lower surface 106 of the mop head 102 to clean a horizontal surface. In this position, the spring 116 creates only minor resistance to further rotation of the handle thereby allowing easy use of the mop 100. However, if the user attempts to rotate the handle substantially beyond the position marked as B, the spring 116 will resist the movement sufficiently to prevent the mop head 102 from moving to an unusable position. When the user wishes to use the upper surface 104 of the mop 100 to clean a horizontal surface, the user merely flips the handle over thereby bringing the upper surface 104 close to the horizontal surface to be cleaned. The mop head mount 14 can then be flexed to the position marked as C so that the handle is in a comfortable position during use of the mop 100. The configuration shown in FIGS. 9 and 10 allows for easy use of either the upper 104 or lower 106 surface without the necessity of forcing the mop head mount 14 past a pivot stop.

The cleaning material configured for use with a mop 10 according to the present invention has utility beyond the illustrated mops 10. For example, cleaning material 40 as illustrated in FIG. 3 can be torn from a roll 42 of such material 40 and used by hand to clean up a spill or other mess. A user may keep a refill roll handy for this purpose. Such material 40 can be especially useful when cleaning up objectionable messes that the user does not wish to contact with their hand. The moisture barrier layer 68 prevents waste contacting the bibulous layer 66 from being transported through to the user's hand. In addition, the adhesive 64 disposed on the moisture barrier layer 68 can be used to stick the cleaning material 40 to a user's hand for small cleanup jobs. A piece of material 40 can be stuck to the user's hand and formed around fingers and thumb and used to clean objects such as individual slats of vertical blinds and fan blades on ceiling fans. The user merely needs to wipe the object to be cleaned instead of wiping it with their bare hand. There is no need to grip the cleaning sheet; instead, the cleaning sheet hangs onto the user's hand.

The adhesive can also advantageously be used to stick portions of a cleaning sheet to itself. For example, if a person picks up an objectionable piece of waste with the bibulous layer of the cleaning material, the person can then crumple the piece of cleaning material around the piece of objectionable waste causing the adhesive on portions of the moisture barrier layer to contact other portions of the cleaning material causing the entire crumpled sheet to remain crumpled. This is similar to the effect created when crumpling up a piece of adhesive tape; a compact and secure ball can be formed. The adhesive side of the sheet can also be used to pick up crumbs, pet hair, and other debris. Like considerations apply with cleaning material that does not include the moisture barrier layer. The individual cleaning sheets or portions of the roll of cleaning material can be used to clean objects and surfaces without the use of a mop.

The above discussion has focused primarily on the cleaning of surfaces such as floors. However, the present invention has utility in cleaning many types of surfaces, including but not limited to walls, windows, mirrors, tables, ceilings, and furniture. Therefore, it should be understood that the word "floors" should be broadly construed to include other surfaces to be cleaned.

Referring now to FIGS. 11–15, a cleaning tool 200 according to a fourth embodiment of the present invention is illustrated in several views. This embodiment is more specifically directed towards the cleaning of surfaces other than floors. Specifically, the cleaning tool is designed to be used by hand rather than by using an elongated handle, as with the earlier embodiments of the mop. This cleaning tool 200 is well suited to cleaning countertops, mirrors, walls, as well as the coat of a pet or the skin of a person. In this embodiment, a central core 202 takes the place of the mop head in the prior embodiments. That is, the core 202 defines the center of the cleaning tool 200. The core 202 may be made from many materials including paper, plastic or plastic film, or a variety of fabrics. The core 202 has an upper surface 204 and lower surface 206, as best shown in FIG. 14. A plurality of cleaning sheets 208 is supported on the lower surface 206 in a stacked configuration. Preferably, a second plurality of cleaning sheets 208 is supported on the upper surface 204 also in a stacked configuration.

As best shown in FIG. 11, the cleaning tool 200 is preferably designed so as to accommodate a human hand 210. Specifically, the core 202 has an opening 212 at one end and is closed at its other end 214. The core 202 is preferably tapered from the open end 212 down to the closed end 214. The hand 210 may be slid into the opening 212 so that the hand 210 is positioned inside the core 202. Then, the core may be positioned such that the lower surface is directed towards a surface to be cleaned, thereby bringing the outermost cleaning sheet 208 into contact with the surface to be cleaned. The surface may then be wiped to clean the surface thereby causing the outermost sheet 208 to become soiled. As with the prior embodiments, the soiled outermost sheet may be removed from the remaining stack to expose a new unsoiled sheet.

In plan view, the cleaning tool is generally rectangular with an end-to-end width (the distance between the ends 212 and 214) greater than its front-to-back length (the distance between the leading edge and trailing edge). In one preferred embodiment, the tool has an grip the cleaning sheet; instead, the cleaning sheet hangs onto the user's hand. end-to-end width of approximately 9 inches and a front-to-back length of approximately 7 inches, though other sizes and shapes are certainly possible.

The mitt is generally rectangular in cross-section with a thickness (the distance between the upper surface and the lower surface) less than its front-to-back length. In one preferred embodiment, the mitt has a thickness of approximately one inch. As shown, the upper and lower surfaces are preferably slightly convexly curved in cross-section, but alternatively may be flat or greatly curved. Like the mop embodiment, some embodiments of the cleaning tool may be considered an oblate roll.

Figure 15:
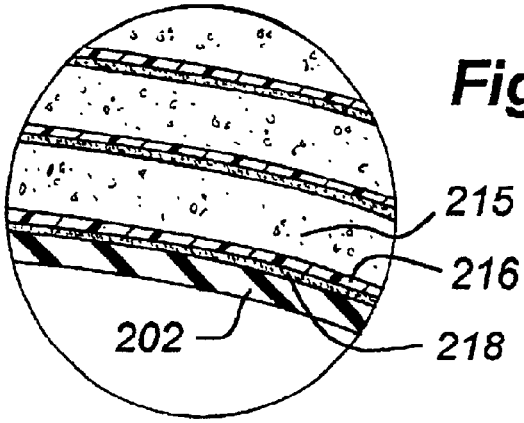
FIG. 15 is a detailed blow up view of a portion of the cleaning tool of FIG. 14, the magnified portion being indicated by circle 15 in FIG. 14.

The cleaning tool of the fourth embodiment may be constructed in any of the ways discussed as with the mop. That is, a single stack of cleaning sheets may be positioned on only one face of the core. More preferably, a continuous roll of cleaning sheets may be wrapped about the core so as to define a stack of cleaning sheets on both the top and bottom. This is illustrated in FIGS. 11–13. Also, as shown in FIG. 15, the cleaning sheets preferably each consist of a bibulous layer 215 which overlies a moisture barrier layer 216. The moisture barrier layer 216 may be coated with an adhesive 218 to adhere the adjoining layers to one another. As with the prior embodiments, the cleaning sheets may be constructed in other ways. As shown in FIGS. 11 and 12, the moisture barrier layers 216 may extend beyond the edges of the bibulous layer 215 so as to define a perimeter. The perimeters of the various layers may be adhered to one another by a releasable adhesive or bonding so as to seal each bibulous layer between adjacent moisture barrier layers. This would allow the cleaning tool or mitt 200 to be dipped into water causing only the outermost bibulous layer to be wetted. Also, the perimeter may have an adhesive coating to allow it to pick up debris. As shown in FIG. 14, the moisture barrier layers 216 may extend only to the edges of the bibulous layers 215 and not extend into the perimeter area. As a further alternative, the innermost moisture barrier layer 216 may form the core 202, as illustrated in FIG. 12. Also, the core 202 may be rigid or flexible.

Figure 16:
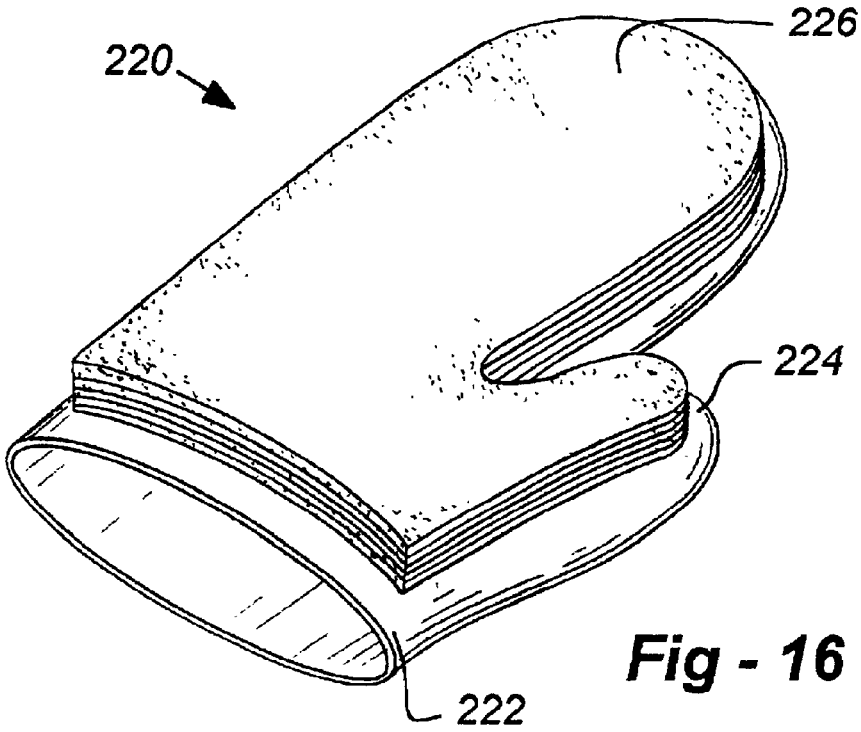
FIG. 16 is a perspective view of a cleaning tool according to a fifth embodiment of the present invention wherein the core of the cleaning tool is mitt shaped.
Figure 17:
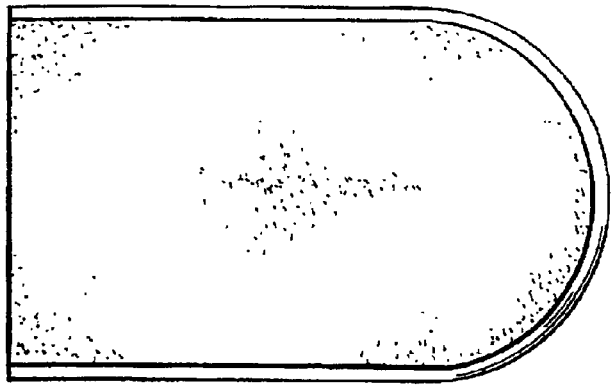
FIG. 17 is a top view of a cleaning tool according to a sixth embodiment of the present invention.

Referring now to FIG. 16, a fifth embodiment of the present invention is illustrated in the form of a mitt 220. This embodiment has a mitt shaped core 222, which is preferably flexible. As shown, the core 222 is mitt shaped or hand shaped including a thumb portion 224. In this embodiment, a plurality of cleaning sheets 226, which are also mitt shaped, are stacked on one surface of the mitt shaped core 222. FIG. 17 shows a sixth embodiment of the present invention which may also be considered mitt shaped, though it is without a thumb portion.

In each of the embodiments of the cleaning tool, each cleaning sheet may include both a backing or moisture barrier layer and a bibulous layer, or may exclude the backing or moisture barrier layer. Also, independent of whether the cleaning sheets include a moisture barrier layer, the bibulous layer may be pretreated with variety of substances. For example, the bibulous layer may be pretreated with a cleaning solution such as window cleaner or a soap product. It may also be pretreated with a scent compound, a wax, a dusting oil, a shine enhancer, an antibacterial material, hair cleaner, hair conditioner, as well as medical substances. Certain versions of the present invention may be specifically constructed for use on pets. In this case, the bibulous layer may be pretreated with a substance designed to clean the coat of a pet. Alternatively, or in addition, the layer may be coated with a conditioning agent for the pet's coat. As mentioned previously, medical substances may be included. For example, a skin treatment substance may be embedded in the bibulous layer for application to the skin of a human or pet. Scent compounds applied to the bibulous layer may allow transfer of a scent to the coat of an animal. All or part of the outwardly facing surface of the cleaning sheets may be coated with an adhesive to facilitate collection and retention of debris. For example, the outer surface may be pattern coated with an adhesive so that the cleaning tool effectively picks up and retains pet hair and dander. A combination of various substances as well as adhesives may be applied to certain embodiments.

The bibulous pads or the bibulous layers of the above discussed embodiments may be pretreated with a variety of substances. This includes dusting oils and cleaning solutions. As one example, pads or the layer may be pretreated with a dry anti-bacterial substance, which becomes activated with the pad, or layer is wetted. All pads or the entire bibulous layer may be treated with one substance such as the dusting oil or cleaning solution. Alternatively, different portions of the bibulous layer or different bibulous pads may be treated with different substances. As one alternative, the embodiment of the tool having bibulous pads separated by gaps may have pads treated with one substance alternate with pads treated with a second substance. The first substance may be a solvent while the second substance may be a neutralizer. The pads located on the upper surface point to the mitt would be treated with the first substance while the pads located on the lower surface of the mitt would be treated with the second substance. Therefore, the user would first use the pads located on one of the surfaces to apply the first substance, and then would rotate the tool 180 degrees to use the pads located on the other surface. As another example, the pads located on the lower surface of the mitt may be treated with a cleaning solution while the pads located on the upper surface of the mitt is not pretreated and therefore merely absorbent. The user would use the pads located on the lower surface to apply cleaning solution to the surface to be cleaned and would then rotate the mitt and use the pad located on the upper surface to absorb the cleaning solution from the surface to be cleaned. Many other variations on this approach fall within the present invention. A cover may be provided to protect the tool and retain the pretreated materials.

In the embodiment shown in FIGS. 11 and 13, the web of material includes perforations 209 to allow a portion of the web of material to be removed from the remainder of the web. Most preferably, the perforations are located on the leading and trailing edges of the roll so that a portion of the web forming the upper or lower surface may be removed in its entirety, thereby exposing a fresh surface. The perforations may either be cut after the roll is formed or the material may be perforated prior to forming the roll. By "perforations," it is meant that the web has areas designed to tear or separate. This includes the use of a weakened area, a series of small cuts, or one or more large slits. Optionally, a slit across the web may also be employed. Also, the perforations may only be provided on one edge, rather than both the leading and trailing edges.

The cleaning tool may be configured so as to allow the use of refills. The roll or stack of cleaning sheets can be formed such that they may be removed from a rigid or flexible core and replaced with a new stack or roll. The roll may be formed with some type of core, such as a cardboard tube, or as a coreless roll. Either way, the roll is optionally configured to be placed over the core. Once the roll of cleaning material is used up, a new roll can be placed on the core.

Other variations on the cleaning tool are also possible. Any of the configurations discussed with respect to the mop may be applied to the tool.

Figure 18A:
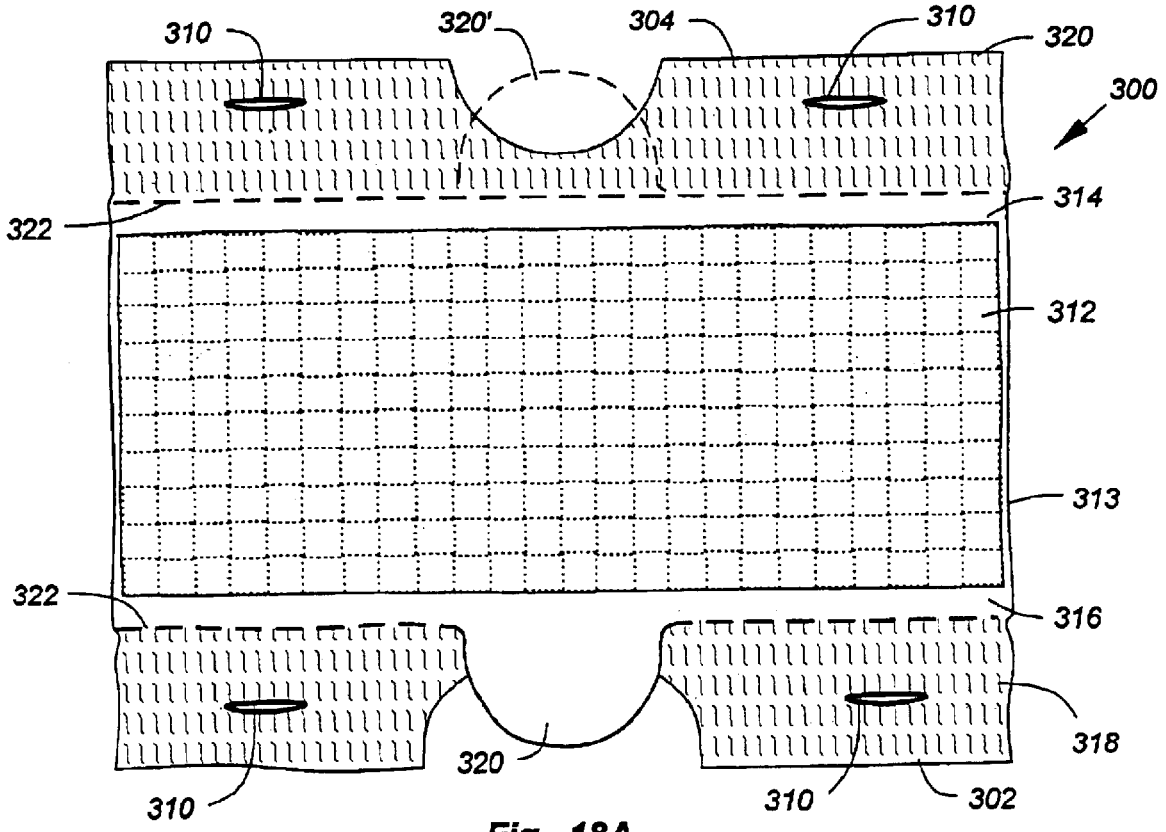
FIG. 18A is a plan view of a refill for a mop according to the present invention.
Figure 18B:
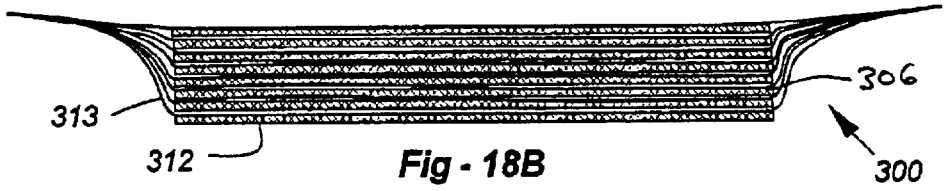
FIG. 18B is an end view of one embodiment of a refill for a mop.

Referring now to FIGS. 18A and 18B, an additional embodiment of a refill for a mop or cleaning tool is generally shown at 300. The refill 300 is designed to provide the benefits of previous versions of the present invention for use with mops or cleaning tools designed to use disposable single cleaning sheets. Examples of these mops include the SWIFFER® and the GRAB-IT® mops. These mops have a mop head with a lower surface that is generally smooth and flat and an upper surface with gripping members for gripping the edges of a cleaning sheet. A single disposable cleaning sheet is wrapped around the mop head and the edges of the cleaning sheet are gripped by the gripping members to hold the cleaning sheet in position on the lower surface of the mop head. These cleaning sheets are typically not designed for wet use, but instead for light duty cleaning, such as dusting. Refill 300 is designed for use with this type of mop, but may also be used or adapted for use with other types of mops, as will be clear to those of skill in the art.

Figure 19A:
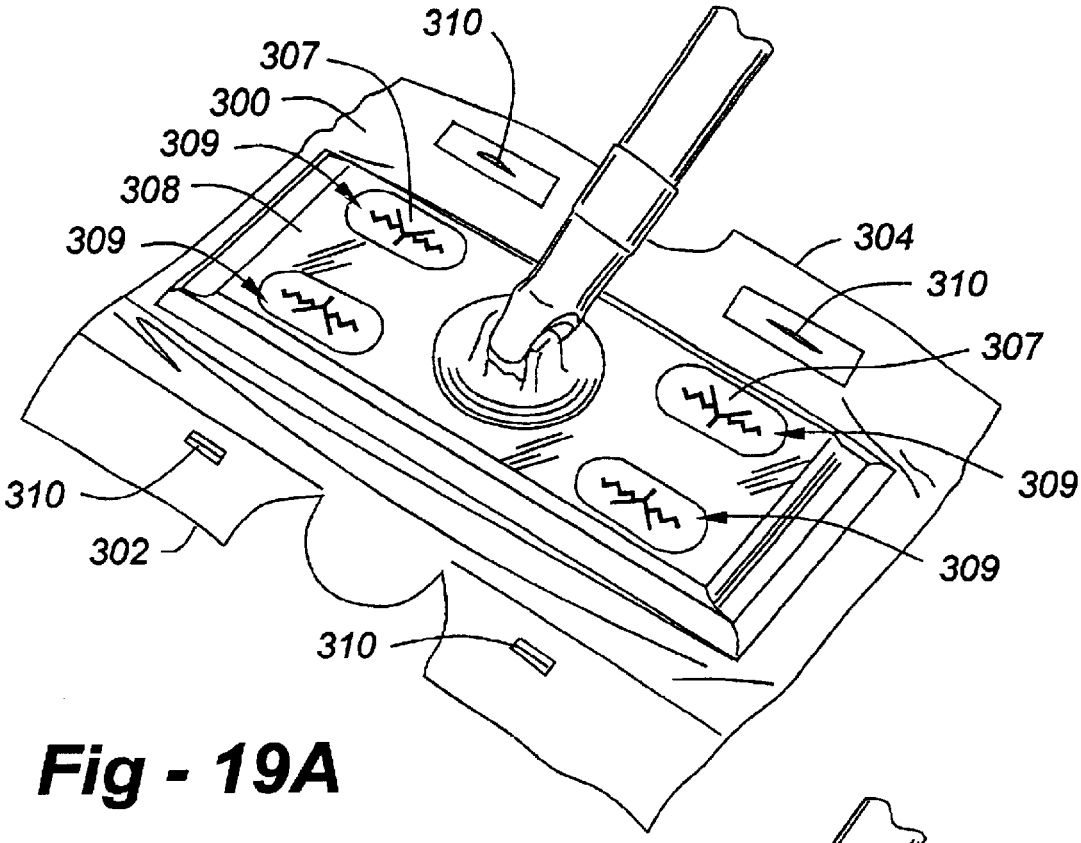
FIG. 19A is a perspective view of a mop head positioned for attachment of a refill according to the present invention.
Figure 19B:
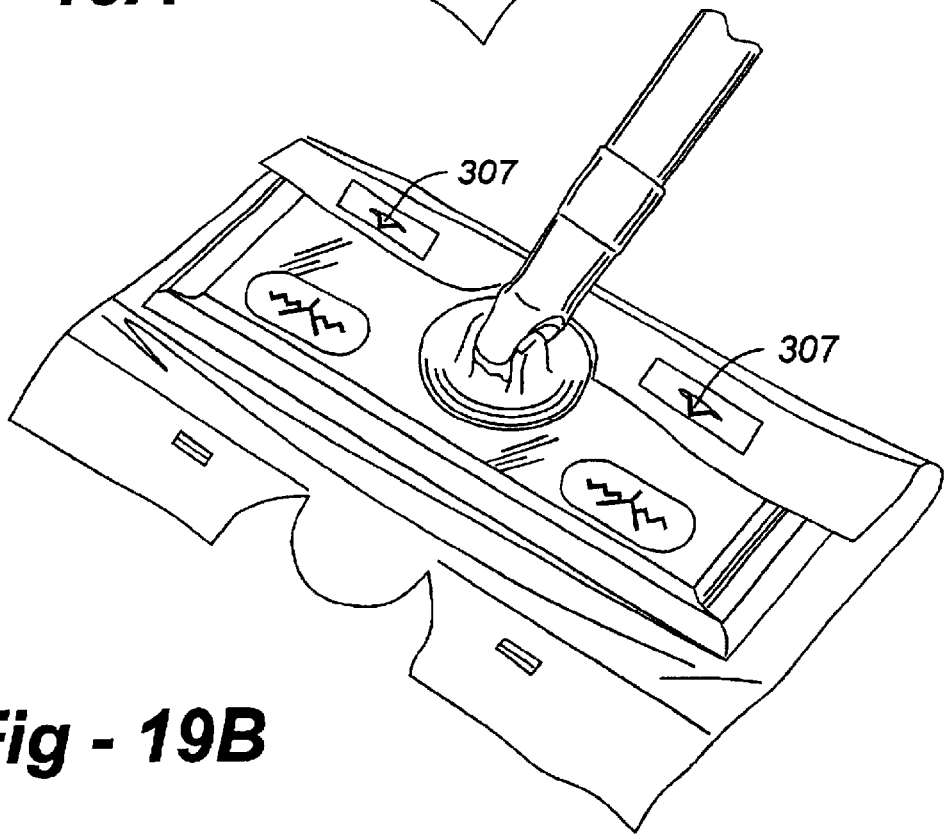
FIG. 19B is a perspective view similar to FIG. 19A, with one edge of the refill attached to the mop head.
Figure 19C:
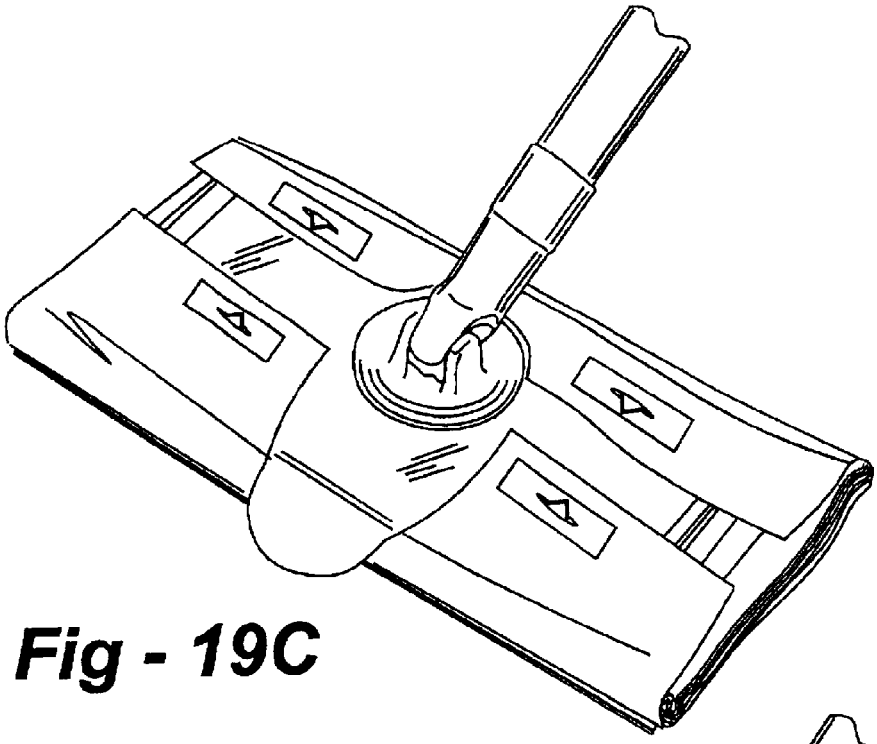
FIG. 19C is a perspective view similar to FIGS. 19A and 19B showing both edges of the refill attached to the mop head.

The refill 300 has a pair of opposed edges, which may be referred to as a front edge 302 and a rear edge 304. A plurality of cleaning sheets 306 are supported between the edges 302 and 304. Referring now to FIGS. 19A–19D, the refill 300 is shown during installation and use. Referring to FIG. 19A, a generally rectangular mop head 308 is shown placed against the rear or upper surface of the refill 300 intermediate the edges 302 and 304. FIG. 19B shows the rear edge 304 wrapped around the rear edge of the mop head and attached to the upper surface. FIG. 19C shows the front edge 302 wrapped around the mop head and attached to the upper surface. As will be clear to those of skill in the art, the gripping members that hold the refill to the mop head may be of several types. In one preferred embodiment, the mop head has attachment tabs 307 that extend generally upwardly and inwardly from adjacent the outer edges of the top surface of the mop head. Slits near the edges of the refill are placed over these tabs to hold the refill in place. As an alternative, clips or clamps may be provided on the top side of the mop head. As yet another alternative, adhesive may be used to hold the refill in place. For example, the refill may have adhesive strips, such as used on disposable diapers, which can be used to attach the refill to the mop head or to itself. The approach such as used for attaching sandpaper to a sanding block may also be used. The mop head 308 illustrated in FIGS. 19A–19D has irregular cut grippers 309 generally near the four corners of the rectangular mop head. The grippers 309 are cut so as to define the tabs 307. Alternatively, edges of a cleaning sheet or the refill 300 may be pressed into the grippers 309 to hold the edges.

Figure 19D:
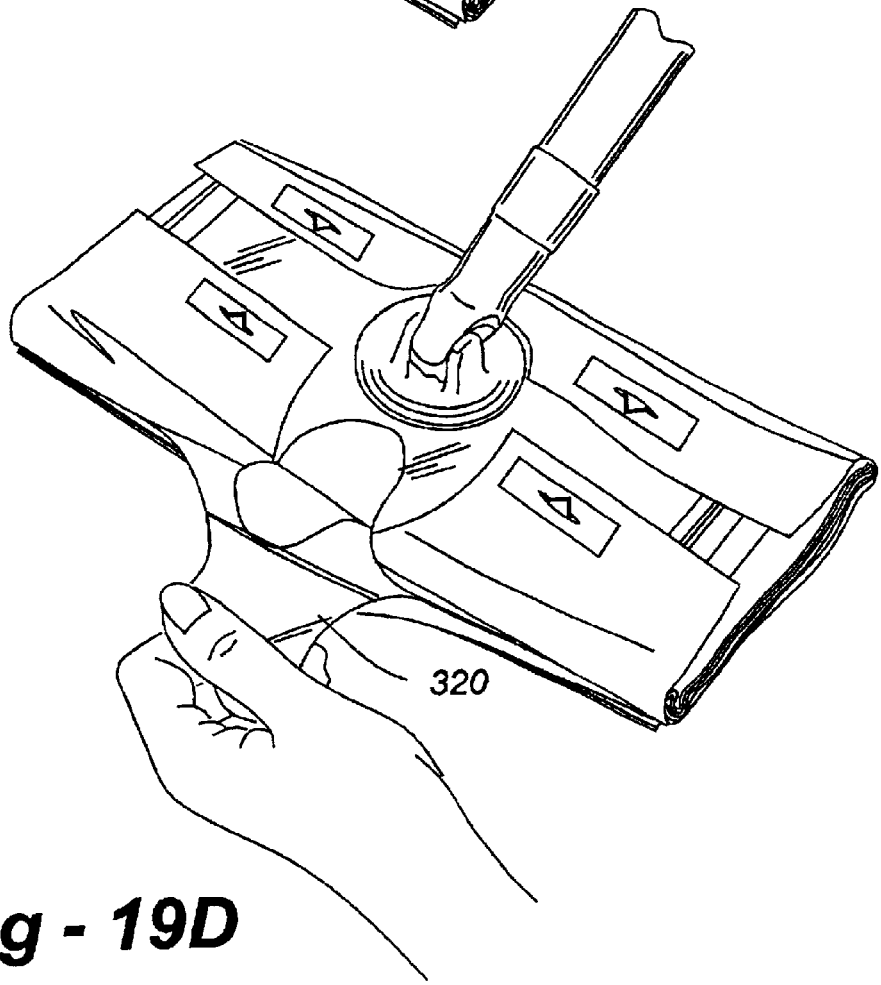
FIG. 19D is a perspective view of a mop head with a refill installed thereon, showing a soiled outer sheet being removed.

Preferably, the refill 300 consists of multiple cleaning sheets in a stacked configuration. FIG. 19D shows an outermost soiled cleaning sheet being removed from the remainder of the refill. Referring again to FIG. 18A, slits 310 may be seen near the edges 302 and 304 of the refill. These slits may be used for attaching the refill to the tabs 307 of the mop head 308.

There are several variations on the refill 300. In one preferred embodiment, a plurality of cleaning sheets is provided in a stacked configuration, with each of the cleaning sheets consisting of a cloth-like cleaning layer and a backing layer. This embodiment is shown in FIG. 18B. The cloth-like cleaning layer may be made from a wide variety of materials. As discussed previously, non-woven, spunbonded, or spun laced fibrous sheets may be used as a bibulous layer. As discussed previously, "bibulous" is defined as having the ability to absorb a liquid. The term "cleaning layer" or "cloth-like layer" includes bibulous layers of all types, as well as cleaning layers that may be less absorbent. Generally, a cleaning layer varies between being highly absorbent and being capable of holding a strong static charge. For some dusting and cleaning applications, a static charge is desirable in order to collect and retain dust. However, some fabrics with strong static bearing capabilities are only slightly bibulous or may actually repel water. Between the extremes of strong absorbency and strong static carrying capability are materials that work reasonably well for both applications. Cloth-like cleaning layers for use with the present invention may be any of these materials, including bibulous and non-bibulous materials, woven and non-woven materials and fibrous materials including paper towel-like cloths. An example of a material that has high static carrying capability is PET (polyethylene terephthalate) and similar materials. A blend of PET and a material such as rayon gives some static carrying capability and some absorbency. The backing layer may be any of a variety of materials that provide support to the cleaning layer, including a moisture barrier sheet or layer, as discussed with previous embodiments of the present invention. Alternatively, the backing layer may be a paper or other material capable of absorbing or passing moisture. Also, the backing layer may assist in the cleaning function of the cleaning sheets. For example, the backing may help to provide or hold the static charge or may include an adhesive for collecting and retaining debris. In one embodiment, the backing layer is a non-woven material that may be the same or different than the cleaning layer which may be a non-woven material. For example, the backing layer may be thinner and/or denser. The backing layer could also be a mesh or scrim layer.

Referring again to 18B, the backing layers of each cleaning sheet may extend beyond the edges of the cleaning layer at the front and rear edges. In FIGS. 18A and B, the cleaning layer is shown at 312 for the outermost cleaning sheet, with the backing layer 313 extending beyond the cleaning layer and forming a front margin 316 and a rear margin 314. The margins of each of the cleaning sheets are then interconnected, such as by adhesive or bonding. The interconnected areas 318 and 320 are shown by patterned areas in the margin areas. The interconnected portions will be referred to as bonded, with "bonded" including any approach to interconnecting the edges. In one preferred approach, heat bonding or sonic welding is used, which essentially transforms the multiple individual layers into a single merged layer. By interconnecting just the backing layers, which may be a thin plastic, paper, or non-woven material, the margins are much thinner than if the cleaning layer continued to the very edge. Also, this approach conserves the cleaning layers for the zone that is actually used for cleaning purposes, rather than the portion of the refill that wraps around the top of the mop and is not used for cleaning.

Because the edges are thin, they can be attached to the gripping means, such as tabs 307, used on a mop designed for a single sheet at a time. Preferably, the edges of a refill according to the present invention for use with a mop head with gripping means have a thickness of ¼ inch or less, with ⅛ inch or less even more preferred. It is notable that the edges in various embodiments of the present invention are preferably much thinner than the midportion. For example, in the embodiment of FIG. 18B, the midportion may have a thickness of a ½ inch, ¾ inch, or 1 inch or more, while the edges may have a thickness of significantly less than ⅛ of an inch.

As with other embodiments of the present invention, the cleaning layer may be interconnected with the backing layer by any of a variety of approaches, including adhesive, or bonding. Alternatively, they may be integrally formed. Also, adhesive may be applied to a portion of the margins on either the front margin, the rear margin, or both. The adhesive in the margin, if provided, serves two purposes. First, it helps to grab and hold debris that is pushed ahead or drug behind the cleaning layer. Secondly, when removing the soiled outer sheet, the adhesive coated margins help prevent dirt from falling off of the soiled cleaning sheet and allow the cleaning sheet to be crumpled with the adhesive sticking to other portions of the sheet.

Intermediate the bonded portions of the margins and the area where the cleaning layer is connected, perforations 322 are preferably provided. The perforations may be adjacent the cleaning layer 312, or farther outboard. Perforations allow for separation of the inner portion of each cleaning sheet from the interconnected edges once the outermost cleaning sheet is soiled. Tabs 320 are preferably provided adjacent the front edge 302 for grasping by a user to remove the soiled cleaning sheet. As discussed previously with respect to other embodiments of the present invention, other approaches to allowing separation of an individual sheet may be provided. For example, instead of perforations, weakened areas may be provided. An optional rear tab 320 may be provided adjacent to each of the rear edges 304 of the refill 300. The second tab 320' allows the outermost soiled sheet to be pulled away from either side and also allows a user to grip a tab on the front and rear to minimize soiling of their hand and flipping of debris off the sheet.

Figure 18C:
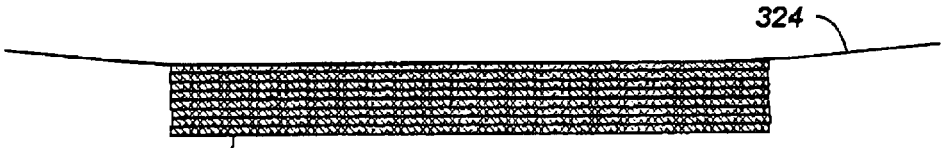
FIG. 18C is an end view of an alternate embodiment of a refill for a mop.

As another alternative, a single backing sheet may be provided with individual cleaning sheets interconnected with the backing sheet by adhesive or stapling, sonic, heat or mechanical bonding, or other approaches. This approach is shown in FIG. 18C. The single backing sheet 324 may then be wrapped around the mop head and attached to the gripping means. The backing sheet may just be a larger, stronger and/or thinner or thicker cleaning sheet than the remaining cleaning sheets. As another alternative, the refill may be provided with only cleaning layers, rather than with alternating backing layers. For example, a stack of bibulous material sheets, such as non-woven sheets 326, may be stacked on a backing sheet 324 that is wrapped around the mop head, with individual sheets 326 being peeled away as they become soiled. All or portions of the bibulous sheets 326 may be bonded together, or otherwise interconnected.

In the embodiment of FIG. 18C, the cleaning sheets 326 are formed into a stack that is generally centered on the backing sheet 324. They are sized such that each of the cleaning layers 326 is disposed on the lower surface of the mop head when the backing sheet 324 is wrapped around and connected to the gripping means on the upper side of the mop head. That is, the cleaning layers or sheets 326 do not wrap around the mop head. Tabs or non adhesively attached portions of the cleaning sheets 326 may be provided to ease gripping and removal of a soiled outer sheet. The cleaning sheets 326 may be treated or pretreated with cleaning material or with adhesive, depending on the application. They may also be statically charged. As one example, the cleaning sheets may be pretreated with a tackifier or may be formed of materials that are naturally tacky or staticy so as to aid in picking up and retaining debris. The cleaning sheets may be formed in accordance with any of the other embodiments of the present invention.

Alternatives on the version of FIG. 18C include extending the cleaning sheets further to the sides so that they partially wrap up around the edges of the mop. Another alternative includes providing each of the layers in the stack on the backing sheet 324 with multiple layers. For example, each sheet may include a bibulous layer and a moisture barrier layer, but with each layer supported in a stack on the backing sheet and smaller than the backing sheet. In any of the embodiments, the individual sheets may be interconnected with adhesive or in any other way that allows individual soiled sheets to be torn away as they are used. As one example, individual sheets may be interconnected with each other by heat bonding or sonically welding the sheets together in small areas, such as dots. Alternatives include oval, square or rectangular shaped bonded areas, or shapes such as stars. By providing a plurality of these small bonded areas, the sheets may be reliably retained in the stacked configuration. At the same time, by choosing appropriately sized small bonding areas, a sheet may be peeled away by separating a sheet at each of the bonded areas. If the bonded areas are small enough in diameter and properly formed, when the soiled outermost sheet is separated, the sheet should cleanly separate without leaving behind tufts or portions of the soiled sheet. As yet another alternative, a backing layer may be provided behind each cleaning-layer, but with the backing layer not necessarily being a moisture barrier layer. For example, the layer may be porous, or otherwise incapable of preventing penetration of liquid. As another alternative, a moisture barrier layer may be provided as a coating on a cleaning layer, rather than being an individual sheet of moisture barrier material. The cleaning sheets may be held in their stacked configuration either by sonic, heat, or mechanical bonding, adhesive, or being stapled to one another adjacent their edges. Preferably, the staples, if used, are embedded or placed far enough towards or around the edges such that they do not contact the surface to be cleaned during use.

Another alternative embodiment of a refill for a mop head designed to receive a single cleaning sheet would include a stack of cleaning sheets with each cleaning sheet consisting of a moisture barrier layer and a bibulous layer. In this embodiment, the moisture barrier layers and the bibulous layers are coextensive such that both layers extend entirely to the edge. The edges may then be interconnected in any of the previously described ways such that the edges may be attached to the gripping means on the top side of the mop head. The moisture barrier layers may be sheets of plastic or a coating. Alternatively, the refill may include sheets each with multiple layers, with the layers not including the moisture barrier layer.

Figure 18D:
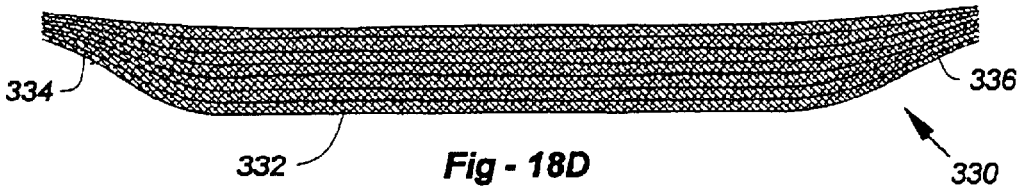
FIG. 18D is an end view of another alternative embodiment of a refill for a mop.

FIG. 18D shows another alternative embodiment of a refill 330 which consists of a stack of individual cleaning sheets 332 that are generally coextensive such that the entire stack is wrapped around the mop head and attached to the gripping means on the upper side of the mop head. The leading edge 334 and trailing edge 336 of the refill 330 consists of the individual cleaning sheets being compressed and bonded together, such as shown. In the illustrated embodiment, each of the cleaning sheets 332 consists of a single non-woven cleaning layer. The portion of the individual layers adjacent the edges are interconnected such as by heat, sonic, or mechanical bonding or by other means. High pressures and/or temperatures may be used so as to significantly reduce the overall thickness near the edges to allow for easier interconnection with a mop head. Preferably, the thickness of the edges is reduced to less than a ¼ inch, and more preferably to less than a ⅛ of an inch. This may amount to a significant reduction in thickness. For example, the midportion of the stack, where the individual sheets are not compressed, may have a thickness at least three times greater than the compressed edges. In some embodiments, the thickness ratio may be 6:1, 8:1, or more. Slots may be provided adjacent to edges for interconnection with tabs, as previously discussed. In one preferred version of this embodiment, the sheets are configured as was shown with the embodiment of FIG. 18A. That is, perforations may be provided intermediate the interconnected edges and the central portion of each sheet so as to allow removal of the central portion of each sheet as it becomes soiled. Alternatively, weakened portions may be provided. Tabs on the leading and/or trailing edges may be provided to assist in removing each outer sheet. The individual sheets may be treated with an adhesive or otherwise made tacky to assist in cleaning. The sheets may also be static treated or designed to develop a static charge when passed over a surface to be cleaned. The sheets may be retained in the stacked configuration by the bonded edges, or may include staples or an adhesive or other interconnection means for further interconnecting the sheets.

As further alternatives, the individual cleaning sheets may be somewhat thicker in their central portions and thinner near the edges to allow for easier gripping by the mop head. That is, each individual sheet would have a thicker central portion and a thinner edge portion prior to the edge portions being compressed and bonded to one another. Such a dual thickness sheet may be created by interconnecting two layers, with one layer being smaller than the other such that it does not extend to the edges. Alternatively, it may be integrally formed. As another alternative, backing layers may be provided either for the entire stack or for individual sheets, with the backing layer being materials other than plastic, such as a different type of non-woven material or paper. A refill, similar to as shown in FIG. 18A, may also be constructed in accordance with any other embodiment of the present invention. As one example, pretreated bibulous layers may be centered between moisture barrier layers so that they are sealed in. In this way, a wet, clean sheet may be provided that remains wet due to the fact that it is sealed in.

Preferably, for a refill according to the present invention to work best with a mop head of the type designed to receive a single cleaning sheet, the edges, whether bonded or consisting of a single backing layer, are significantly thinner than the portion of the refill between the edges. For example, in the embodiment of FIG. 18B, it can be seen that the central portion of the refill is substantially thicker than the edges. In order to work with a mop head designed to receive a single sheet, it is preferred that the edges of the refill have a thickness less than ¼ inch. Thicknesses less than this, such as ⅛ inch or less, may work even better, with less thickness being most preferred. The mid portions of the refills, on the other hand, can be substantially thicker since the thickness does not interfere with interconnection with the mop head. It is preferred that a refill include at least three cleaning sheets, with five or more being more preferred. In some embodiments, as many as 10–30 or more cleaning sheets are included in a refill. A stack of cleaning sheets that each include a cleaning layer, such as a non-woven fabric-like material, may have a thickness from ½ to 1 inch in the center portion, though it may be thicker or thinner for certain applications. In an embodiment such as shown in FIG. 18B, and wherein the refill includes 10 cleaning sheets, the thickness in the mid portion may be ½–1 inch or more while the margins have a thickness of only ⅛ inch or less. Obviously, the embodiment of FIG. 18C has a very thin margin less, since it consists of only a single backing sheet 324. In this case, the backing sheet may have a thickness of one one-thousandth or less, while the cleaning layers 326 may have a total thickness of ½ inch or so for a 10 layer refill. The embodiment of FIG. 18D appears to have much thicker margins, though this embodiment may also be created with much thinner margins. For example, the margin areas may be compressed and bonded sufficiently to have a thickness less than ¼ inch with a thickness, with a thickness less than ⅛ inch even more preferred.

The embodiments of the refill shown and discussed with respect to FIGS. 18A–18D and 19A–19D may also be configured as a refill for a handheld cleaning tool, or as a cleaning mitt. For example, the base layer may be provided with a pocket in which a person may insert their hand so that the refill may be worn as a mitt. The refill may also be configured into other shapes and sizes to work more easily as a mitt. Each of the alternative embodiments may be adapted for use as a mitt. In one preferred embodiment, the mitt includes a mitt-shaped wearable base with a stack of cleaning sheets attached to one or more of its surfaces. Each cleaning sheet may include a bibulous layer and a moisture barrier layer, or may include only a cleaning layer. As with all embodiments of the present invention, the bibulous layers may be pretreated with cleaning solutions or other liquids.

Figure 20:
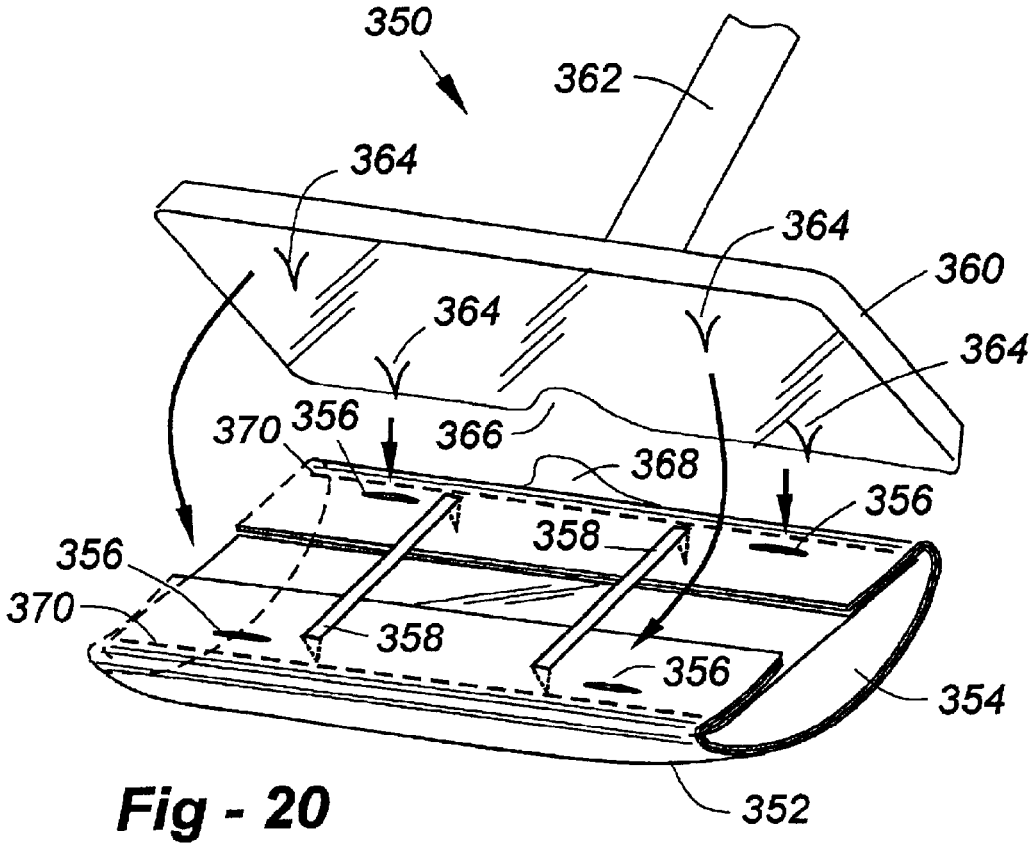
FIG. 20 is a perspective view of another embodiment of a refill for a mop along with the holder portion of the mop.

Referring now to FIG. 20, an additional embodiment of a mop 350 is shown. In this embodiment, cleaning sheets 352 are wrapped about a mop head 354, as shown. Together the stack of cleaning sheets 352 and the mop head 354 form a mop head refill. The mop head refill has holes 356 formed in its top. Staples 358 may be used to hold the stack of sheets 352 to the mop head 354. Alternatively, the sheets 352 may be attached to the head 354 in any other way, including adhesive, sonic, heat, or mechanical bonding, or hot sealing. The head and sheets may also be integrally formed. Shown above the mop head refill, a plastic holder 360 is shown with a mop handle 362 extending upwardly therefrom. The holder 360 has spikes 364 extending downwardly therefrom designed and positioned to engage the holes 356. An indentation 366 is provided to access pull tabs 368 so as to allow removal of dirty outer sheets from the stack 352. Once all of the sheets in the stack 352 are used, the mop head 354 may be removed from the holder 360 and replaced with a new refill. The mop head 354 may have a curved lower surface, as shown, or may be more rectangular with a flat bottom surface. The mop head 354 may be constructed of a variety of materials. In one preferred embodiment, the mop head 354 is a disposable foam or paper material with the cleaning sheets attached thereto. The cleaning sheets 352 may be constructed in accordance with any embodiment of the present invention. For example, each sheet may be a single layer of cleaning material, or may include a backing layer. The sheets may be pretreated with cleaning solution or with a tackifier, or may be naturally tacky. The leading and trailing edges may be adhesively coated to additionally gather debris. Perforations 370 may be provided for releasing the outermost soiled sheet, or weakened areas may be provided, or the sheets may be adhesively interconnected such that the outer sheet may be peeled away. It should be noted that the mop head 354 with the cleaning sheets 352 may be used as a cleaning implement without the remainder of the mop 350.

Figure 21:
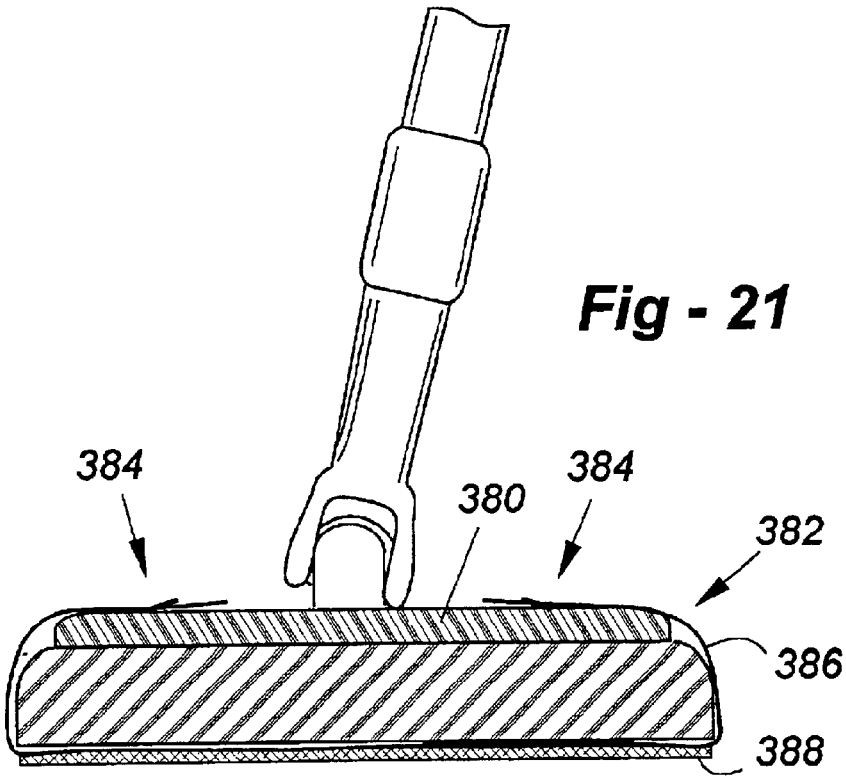
FIG. 21 is a side elevational view of a mop head similar to that shown in FIGS. 19A–19D with an alternative embodiment of a cleaning sheet according to the present invention attached thereto.

Referring now to FIG. 21, a disposable single sheet cleaning refill is illustrated. A mop has a mop head 380 with a design similar to the design discussed with respect to FIGS. 19A–9D. A cleaning sheet 382 is wrapped about the mop head 380 with its edges held by gripping members 384. In the illustrated embodiment, the sheet 382 has a backing layer 386 with a cleaning layer 388 attached thereto. The cleaning layer 388 is connected to the central portion of a backing layer 386 such that it is positioned only on the lower surface of the mop head 380 when the sheet 382 is installed thereon. Alternatively, the cleaning layer 388 may wrap up around the sides. As yet another alternative, the cleaning layer may wrap completely around the mop head and/or be coextensive with the backing layer 386. The backing layer may be plastic or paper or any other material suitable to function as a support layer. In embodiments where the cleaning layer and backing layer are coextensive, a moisture barrier layer may be provided as a coating on the back of a cleaning layer. As one alternative, the sheet 382 may have an outer cleaning layer with a strengthening backing layer, that is not necessarily a moisture barrier layer. This backing layer may be a different type of nonwoven, or any other material that functions to allow the sheet to be attached to the gripping means of the mop head. As just one preferred embodiment, the backing layer is a thin, strong, non-woven layer to which a non-woven cleaning layer is attached to the center thereof such that the cleaning layer is positioned just on the lower surface of the mop head when the sheet is attached thereto. The cleaning sheet 382 may be constructed in accordance with any of the embodiments of the present invention.

Figure 22C:
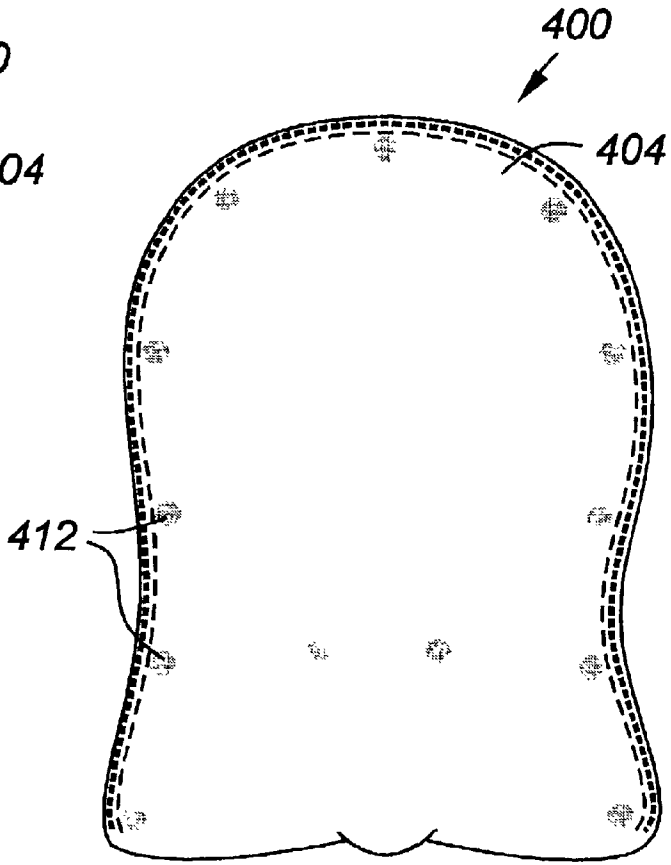
FIG. 22C is a top plan view of the mitt of FIG. 20A.
Figure 22B:
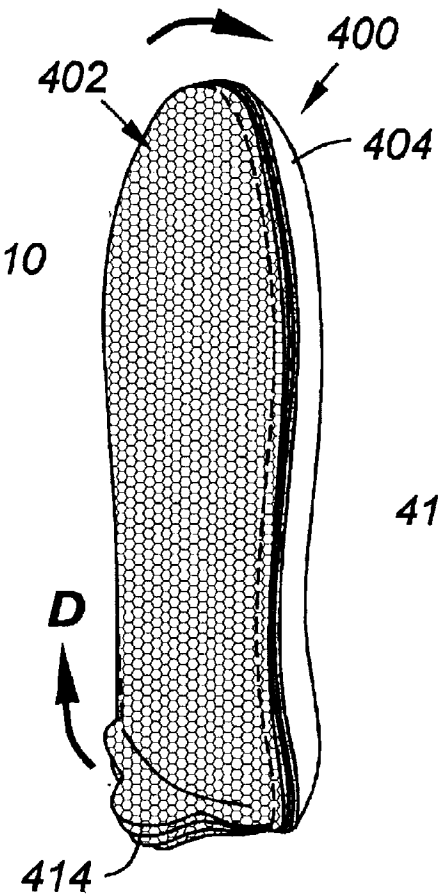
FIG. 22B is a side elevational view of the mitt of FIG. 20A.
Figure 22A:
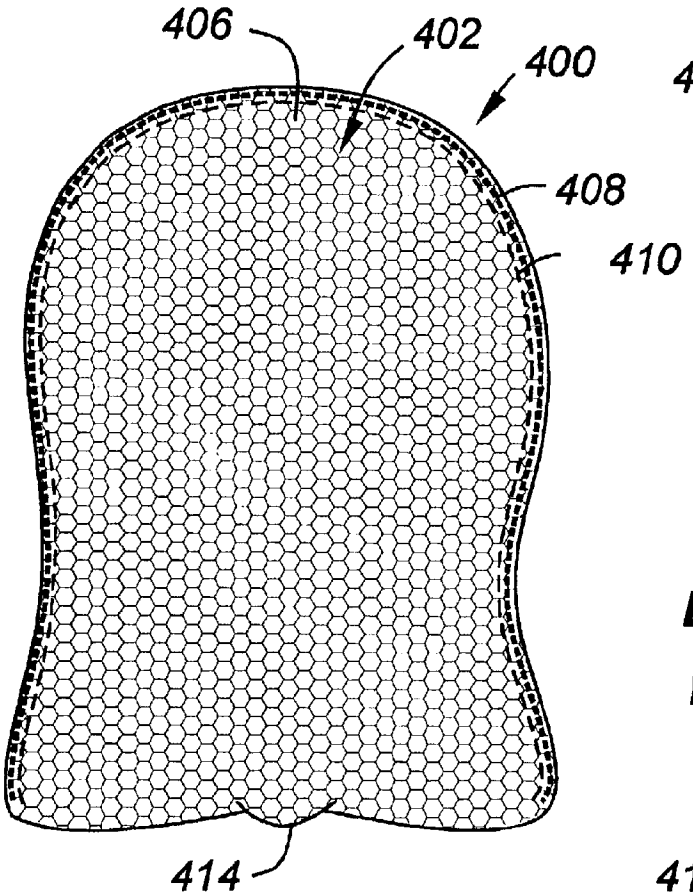
FIG. 22A is a bottom plan view of another embodiment of a mitt according to the present invention.

Referring now to FIGS. 22A–22C, an alternative embodiment of a cleaning mitt is shown generally at 400 having a lower, or cleaning, surface 402 designed to be brought in contact with the surface to be cleaned, and a back or upper surface 404. A stack of cleaning sheets 406 is provided on the lower surface. The cleaning sheets 406 may be maintained in their stacked configuration in any of a variety of ways, such as discussed herein. In one preferred embodiment, the cleaning sheets are each non-woven layers that are sonically or heat welded together at their perimeter as shown at 408. The bottom edge of the perimeter is not joined together so as to leave an opening for inserting a hand between the layers forming a mitt. The perimeter bonding may be continuous, such as a continuous line around the perimeter, or may be discreet points. For example, a series of heat bonded or sonically welded dots may be formed around the perimeter so as to sufficiently join the perimeter. In one embodiment, sonically welded dots with a diameter of 1/32 to 1/8 of an inch are provided around the perimeter. Alternatives include oval, square or rectangular shaped bonded areas, or shapes such as stars. In this embodiment, the cleaning sheets are preferably formed of a non-woven material. The bonding dots allow an outer sheet to be peeled away by separating the sheet at the bonding points. By properly sizing and forming the bonded dots, peeling away the soiled sheet does not leave behind tufts or portions of the sheet.

As an alternative approach to allowing an outer soiled cleaning sheet to be removed, perforations are provided at points or all the way around the bonded perimeter, as shown at 410. Also, the top end of the mitt may be closed or open. As a further aspect of this preferred embodiment, the upper surface 404 of the mitt 400 may have attachment means provided thereon, such as adhesive or VELCRO®-like material, as shown at 412. These may be dots, strips, a pattern, random, or cover the entire surface. When a cleaning sheet becomes soiled, the user grasps the tab 414 preferably provided at the lower edge of the front side and tears away most of the soiled sheet until it is just attached across the upper edge or side 404 of the mitt. The soiled cleaning sheet may then be folded over the top or side of the mitt as shown by arrow D until the soiled side of the cleaning sheet is against the upper side 404 of the mitt 400. It is then held in place by the attachment means. The user then turns the mitt over on their hand and uses it to clean with the reverse side of the cleaning sheet that has been turned over onto the upper side of the mitt. After the reverse side is soiled, the sheet may either be left in place, or torn off the rest of the way. As will be clear to those of skill in the art, the cleaning sheet may also be held in its reverse position in a variety of other ways. For example, a static cling may be provided for holding the sheet in place, or no attachment means may be provided, in which case, the cleaning sheet is held in place on the upper surface of the mitt by the force of the user's hand during a cleaning operation. As another alternative, each of the cleaning sheets may have a backing or moisture barrier layer, and may also have a cleaning layer on the underside of the backing layer such that when the sheet is reversed, a clean cleaning layer is exposed.

The mitt in FIGS. 22A–22C may include cleaning sheets that are co-extensive with each other to form the mitt, or may include a base mitt with cleaning sheets disposed thereon, as disclosed earlier. In either version, two backing layers may be interconnected to form a base mitt for receiving the hand, or no base mitt is provided with the individual cleaning layers instead forming the mitt. In another version, a single layer of plastic is provided with the cleaning layers connected thereto. The plastic layer then ends up on the back of the user's hand when wearing the mitt. Attachment means may be provided on the plastic layer for holding a cleaning sheet that is partially torn off and folded over the mitt to lay against the plastic sheet.

As another alternative, a cleaning mitt, such as illustrated at 400 in FIGS. 22A–22C may be formed by interconnecting a plurality of sheets of a non-woven or cleaning material. In this embodiment, each of the cleaning sheets is coextensive and interconnected at some of its edges by an adhesive or heat, sonic, or mechanical bonding. Alternatively, the individual sheets may be sewn or otherwise interconnected at their edges. Preferably, the sheets are interconnected along three sides so as to leave an opening for inserting a hand. Because the plurality of sheets are not interconnected at the opening side, a hand may be inserted between any of the sheets, such that the hand is positioned in the middle of the stack or elsewhere. This allows variation in the thickness of cleaning material between the hand and the surface to be cleaned.

Preferably, the cleaning sheets are each perforated just inboard of the joined outer edges so as to allow a soiled outer sheet to be removed. Alternatively, some or all of the cleaning sheets may be two layer with a cleaning layer and a moisture barrier or backing layer. In the embodiment in which each cleaning sheet is a single layer of non-woven material, the non-woven material may be the same or similar to materials used in refill sheets for SWIFFER ® and GRAB-IT® mops. As with the previously discussed embodiments of a cleaning mitt, the cleaning mitt constructed of multiple co-extensive layers may be designed such that a layer may be partially torn away and wrapped about the mitt so as to use the backside of the cleaning sheet for further cleaning. The approach of providing cleaning sheets which may be partially separated and turned over to use the opposite side may also be used with a refill for a mop. For example, the mop head may be designed such that it is reversible and individual sheets of the refill may be partially peeled away and folded over onto the opposite side of the mop head. Additional gripping means may be provided for holding the cleaning sheet in the reversed position. The reversed sheet then may be used for additional cleaning.

Figure 23A:
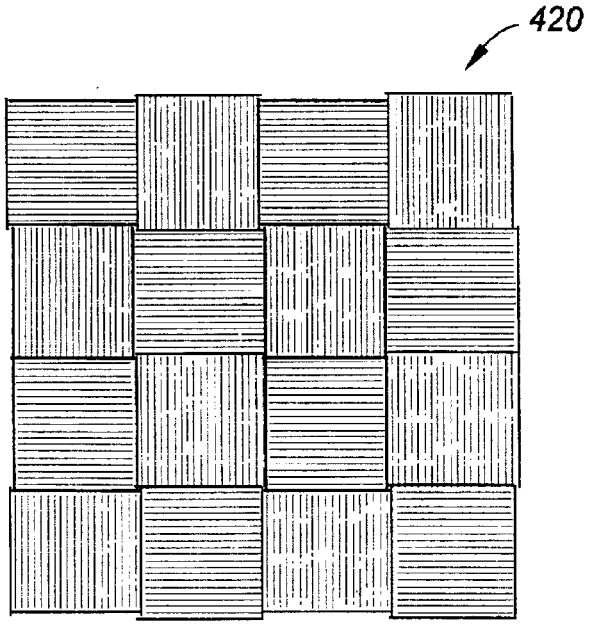
FIG. 23A is a plan view of one embodiment of a cleaning material for use with cleaning mitts and implements according to the present invention.
Figure 23B:
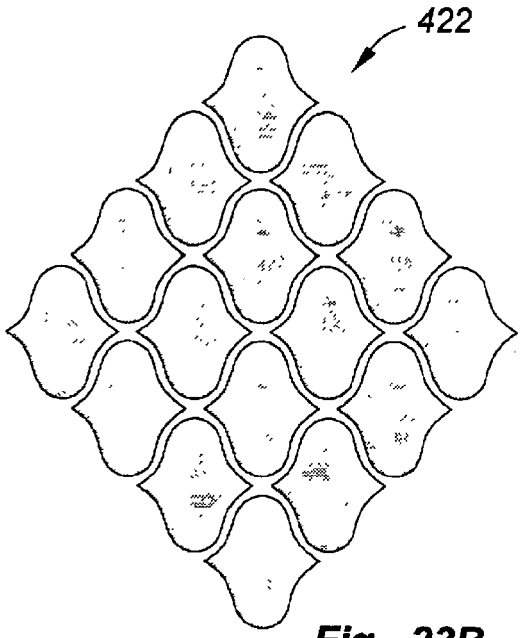
FIG. 23B is a plan of an alternative embodiment of a cleaning material.
Figure 23C:
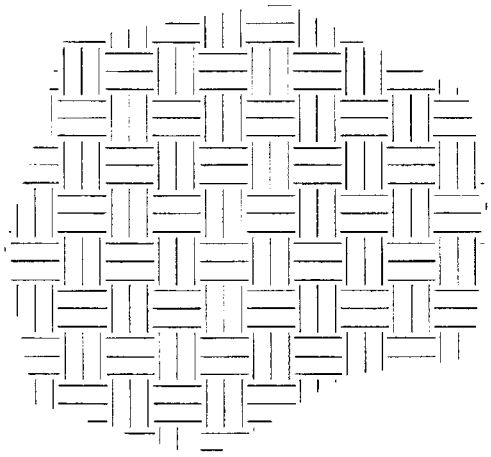
FIG. 23C is a plan view of yet another alternative embodiment of the cleaning material.
Figure 23D:
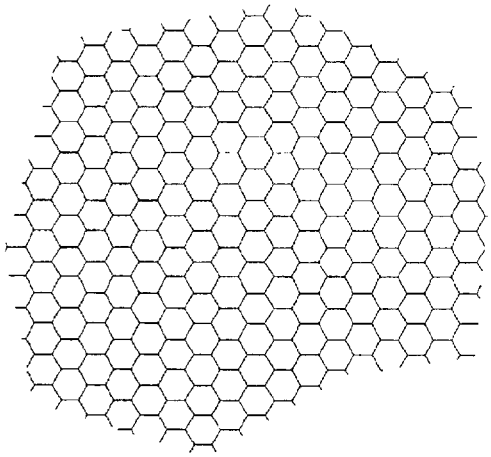
FIG. 23D is a plan view of yet another alternative embodiment of a cleaning material.

FIGS. 23A–23D illustrate alternative versions of non-woven material and may be used to form the cleaning layer for any embodiment of the present invention. In FIG. 23, a non-woven material 420 has a somewhat woven appearance with strands positioned above and below crossing strands so as to give a more three-dimensional texturized affect. This material is considered non-woven since it is not formed with traditional weaving techniques. The material may include reinforcing scrim, as needed. An alternative non-woven material 422 is shown in FIG. 23B. The material 422 represents the material used for SWIFFER(® cleaning sheets. It may also have reinforcing scrim. FIGS. 23C and 23D illustrate yet other alternative embodiments of cleaning material. Some types of cleaning material for use with the present invention are considered multi-dimensional, in that they have a more textured surface. In any embodiment of the present invention, the cleaning sheets may be treated with a perfume or cleaning material, and/or coated or pattern coated an adhesive. The embodiments wherein an adhesive coating is used, a pattern coating is preferred. In pattern coating, only a portion of the surface is actually covered with adhesive, thereby allowing the cleaning material to remain absorbable to or to release materials therefrom, such as cleaning solution or perfume. Additional adhesive may be provided in certain areas to grab and hold debris such as hair.

As yet another alternative embodiment of a cleaning mitt, a pre-moistened mitt or pre-moistened mitt kit may be provided. The mitt would be formed of two or more layers of material, including at least one absorbent layer. The mitt would be provided with a generally moisture impervious container to maintain moisture therein. A kit may be provided with a dry mitt inside of a moisture-proof container along with a cleaning solution to be added to the container to pre-moisten the mitt. Alternatively, the customer may add their own cleaning material. The cleaning solution is either pre-added or added by the customer to the container such that the mitt absorbs the cleaning material. Preferably, the mitt has a moisture impervious liner that the user places their hand in, such that the cleaning solution does not contact the hand. The package may be designed such that the user may place their hand into the moisture impervious liner of the mitt prior to removing the packaging that seals the mitt. The packaging is then torn away to expose the treated cleaning material. Alternatively, the liner could be sealed with a portion being torn off at perforations or a weakened area to access the liner.

In any mitt embodiment of the present invention, the mitt may be generally hand shaped with or without a thumb opening. The embodiments of FIGS. 22A–22C lack a thumb region, thereby allowing them to be used on either hand. Alternatively, a thumb portion may be provided. Also, the mitt may not necessarily be hand shaped. Instead, it may be more rectangular or square, or other shape.

As additional embodiments or variations on any of the embodiments of the present invention disclosed throughout this specification, the cleaning sheets may be provided with a static charge to increase dust collection. As another alternative, the cleaning sheet and/or the backing layer may be given a wrinkled finish so as to improve the pickup of debris. For example, the backing layer may be stretched and then released to create a crinkled appearance.

As an additional embodiment, a stack of unattached cleaning sheets could be wrapped around a dispensing mophead, whereby a plastic lid or cover is snapped onto the top portion of the sweeper tool/mophead with the tabs and perforations remaining outside of the sweeper lid, thus providing a tear-off mechanism.

In view of the teaching presented herein, other modifications and variations of the present inventions will be readily apparent to those of skill in the art. The foregoing drawings, discussion, and description are illustrated of some embodiments of the present invention, but are not meant to be limitations on the practice thereof. It is the following claims, including all equivalents, which define the scope of the invention.

I claim:

1. A refill for a mop of the type having a mop head with a lower surface and an opposed upper surface interconnected by a leading and a trailing edge, the mop head having gripping means provided on the upper surface for retaining a cleaning sheet on the mop head, the refill comprising:

a base layer having a front edge and an opposed rear edge with a midportion therebetween, the base layer configured to be wrapped about the mop head with the midportion adjacent the lower surface of the mop head and the front and rear edges wrapping onto the upper surface of the mop head so as to be retained by the gripping means; and a plurality of cleaning sheets, each removably supported on the midportion of the base layer in a stacked configuration, each of the sheets having an outward face for cleaning and an opposed inward face, the outward face of each of the sheets configured for contacting a surface to be cleaned and thereby becoming soiled, whereby when the outward face of the outermost sheet becomes soiled, the sheet may be peeled away to exposed a non-soiled sheet;

each of the cleaning sheets having a front edge portion and a rear edge portion with a midportion therebetween, the edge portions being disposed at least partially on the upper surface of the mop head when the refill is disposed thereon, the front edge portions of each of the cleaning sheets being bonded to each other and the rear edge portions of each of the cleaning sheets being bonded to each other to hold the cleaning sheets in the stacked configuration, the midportions of the cleaning sheets not being bonded to one another.

2. The refill according to claim 1, wherein the gripping means on the mop head comprises tabs, the base layer having a front margin extending between the front edge and the midportion and a rear margin extending between the rear edge and the midportion, openings defined in the front and rear margins for receiving the tabs such that the refill is retained on the mop head.

3. The refill according to claim 1, wherein the cleaning sheets each are formed of a non-woven material.

4. The refill according to claim 1, wherein the edge portions are bonded to each other with a releasable adhesive.

5. The refill according to claim 1, wherein the base layer comprises a plastic sheet.

6. The refill according to claim 1, wherein the base layer comprises a sheet of non-woven material.

7. The refill according to claim 1, wherein the cleaning sheets are coextensive with the base layer.

8. The refill according to claim 1, wherein the cleaning sheets are sized such that the cleaning sheets wrap around the leading and trailing edges of the mop head when the refill is disposed thereon, but the cleaning sheets do not extend to the front and rear edges of the base layer.

9. The refill according to claim 1, wherein a portion of each of the cleaning sheets is coated with adhesive to facilitate retention of debris.

10. The refill according to claim 1, wherein each of the cleaning sheets is statically charged to facilitate retention of debris.

11. The refill according to claim 1, wherein each of the cleaning sheets is formed of a material that develops a static charge when passed over a surface to be cleaned.

12. A refill for a mop of the type having a mop head with a lower surface and an opposed upper surface interconnected by a leading and a trailing edge, the mop head having gripping means provided on the upper surface for retaining a cleaning sheet on the mop head, the refill comprising:

a base layer having a front edge and an opposed rear edge with a midportion therebetween, the base layer configured to be wrapped about the mop head with the midportion adjacent the lower surface of the mop head and the front and rear edges wrapping onto the upper surface of the mop head so as to be retained by the gripping means; and a plurality of cleaning sheets, each removably supported on the midportion of the base layer in a stacked configuration, each of the sheets having an outward face for cleaning and an opposed inward face, the outward face of each of the sheets configured for contacting a surface to be cleaned and thereby becoming soiled, whereby when the outward face of the outermost sheet becomes soiled, the sheet may be peeled away to exposed a non-soiled sheet; the cleaning sheets being held in the stacked configuration by having portions of each of the cleaning sheets sonically welded to portions of other of the cleaning sheets or the base layer.

13. A refill for a mop of the type having a mop head with a lower surface and an opposed upper surface interconnected by a leading and a trailing edge, the mop head having gripping means provided on the upper surface for retaining a cleaning sheet on the mop head, the refill comprising:

a base layer having a front edge and an opposed rear edge with a midportion therebetween, the base layer configured to be wrapped about the mop head with the midportion adjacent the lower surface of the mop head and the front and rear edges wrapping onto the upper surface of the mop head so as to be retained by the gripping means; and a plurality of cleaning sheets coextensive with the base layer, each removably supported on the midportion of the base layer in a stacked configuration;

each of the cleaning sheets having an outward face for cleaning and an opposed inward face, the outward face of each of the sheets configured for contacting a surface to be cleaned and thereby becoming soiled, whereby when the outward face of the outermost sheet becomes soiled, the sheet may be peeled away to exposed a non-soiled sheet;

each of the cleaning sheets having a front edge portion and a rear edge portion that are disposed at least partially on the upper surface of the mop head when the refill is disposed thereon, the front edge portions of each of the cleaning sheets being bonded to each other and the rear edge portions of each of the cleaning sheets being bonded to each other to hold the cleaning sheets in the stacked configuration; and each of the cleaning sheets comprising a layer of non-woven material, the bonded front and rear edge portions comprising the non-woven material being compressed and heat or sonically bonded such that the overall thickness of the edge portions of the stack of cleaning sheets is substantially reduced in comparison to the overall thickness of the stack of cleaning sheets adjacent the midportion of the base layer.

14. The refill to claim 13, wherein each of the non-woven cleaning sheets is perforated adjacent the front and rear edge portions such that an outermost sheet may be peeled away by separating the sheet at the perforations.

15. The refill according to claim 13, wherein each of the non-woven cleaning sheets has a weakened area adjacent the front and rear edge portions such that an outermost sheet may be peeled away by separating the sheet at the weakened areas.

16. A refill for a mop of the type having a mop head with a lower surface and an opposed upper surface interconnected by a leading and a trailing edge, the mop head having gripping means provided on the upper surface for retaining a cleaning sheet on the mop head, the refill comprising:

a base layer having a front edge and an opposed rear edge with a midportion therebetween, the base layer configured to be wrapped about the mop head with the midportion adjacent the lower surface of the mop head and the front and rear edges wrapping onto the upper surface of the mop head so as to be retained by the gripping means; and a plurality of cleaning sheets coextensive with the base layer, each removably supported on the midportion of the base layer in a stacked configuration;

each of the cleaning sheets having an outward face for cleaning and an opposed inward face, the outward face of each of the sheets configured for contacting a surface to be cleaned and thereby becoming soiled, whereby when the outward face of the outermost sheet becomes soiled, the sheet may be peeled away to exposed a non-soiled sheet;

each of the cleaning sheets having a front edge portion and a rear edge portion that are disposed at least partially on the upper surface of the mop head when the refill is disposed thereon, the front edge portions of each of the cleaning sheets being bonded to each other and the rear edge portions of each of the cleaning sheets being bonded to each other to hold the cleaning sheets in the stacked configuration; and each of the cleaning sheets comprising a backing layer that is coextensive with the base layer and a cleaning layer that is not coextensive with the base layer such that the backing layer of each of the cleaning sheets extends beyond the cleaning layer to define the front and rear edge portions which are bonded to each other.

17. The refill according to claim 16, wherein the backing layer of each of the cleaning sheets comprises a moisture barrier layer and the cleaning layer of each of the cleaning sheets comprises a bibulous layer.

18. The refill according to claim 16, wherein the backing layer of each of the cleaning sheets comprises a first non-woven material and the cleaning layer of each of the cleaning sheets comprises a second non-woven maternal.

19. The refill according to claim 18, wherein the first non-woven material is thinner and denser than the second non-woven material.

20. The refill according to claim 16, wherein each of the backing layers is perforated adjacent the front and rear edge portions such that an outer most sheet may be peeled away by separating the sheet at the perforations.

21. The refill according to claim 16, wherein each of the backing layers has a weakened area adjacent the front and rear edge portions such that an outermost sheet may be peeled away by separating the sheet at the weakened areas.

22. A refill for a mop of the type having a mop head with a lower surface and an opposed upper surface interconnected by a leading and a trailing edge, the mop head having gripping means provided on the upper surface for retaining a cleaning sheet on the mop head, the refill comprising:

a base layer having a front edge and an opposed rear edge with a midportion therebetween, the base layer configured to be wrapped about the mop head with the midportion adjacent the lower surface of the mop head and the front and rear edges wrapping onto the upper surface of the mop head so as to be retained by the gripping means; and a plurality of cleaning sheets, each removably supported on the midportion of the base layer in a stacked configuration, each of the sheets having an outward face for cleaning and an opposed inward face, the outward face of each of the sheets configured for contacting a surface to be cleaned and thereby becoming soiled, whereby when the outward face of the outermost sheet becomes soiled, the sheet may be peeled away to exposed a non-soiled sheet;

a portion of each of the cleaning sheets being coated with adhesive to facilitate retention of debris, the adhesive coated portions being portions adjacent the leading and trailing edges of the mop head when the refill is disposed thereon, and the portions of the cleaning sheets disposed on the lower surface of the mop head when the refill is disposed thereon not being adhesive coated.

23. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a cleaning layer having an outward face for cleaning and an opposed inward face, the outward face of each of the cleaning layers configured to contact a surface to be cleaned and thereby become soiled;

each cleaning sheet having a front edge portion and an opposed rear edge portion with a midportion defined therebetween, the front edge portions of each of the cleaning sheets being bonded to each other and the rear edge portions of each of the cleaning sheets being bonded to each other so as to retain the cleaning sheets in the stacked configuration the midportions not being bonded to each other;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and a portion of each of the cleaning sheets being separable from the stack of cleaning sheets without releasing the refill or the individual cleaning sheet from the gripping means, such that when the outermost sheet becomes soiled, the separable portion of the sheet may be peeled away to expose a portion of a non-soiled sheet.

24. The refill according to claim 23, wherein each cleaning layer comprises a non-woven material.

25. The refill according to claim 23, wherein the gripping means on the head comprises tabs, the bonded front and rear edge portions having openings defined therein for receiving the tabs such that the refill is retained on the mop head.

26. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a cleaning layer having an outward face for cleaning and an opposed inward face, the outward face of each of the cleaning layers configured to contact a surface to be cleaned and thereby become soiled;

each cleaning sheet having a front edge portion and an opposed rear edge portion with a midportion defined therebetween, the front edge portions of each of the cleaning sheets being bonded to each other and the rear edge portions of each of the cleaning sheets being bonded to each other so as to retain the cleaning sheets in the stacked configuration;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and each of the cleaning sheets being perforated between the front edge portion and the midportion and between the rear edge portion and the midportion such that the midportion is separable from the stack of cleaning sheets by separating the sheet at the perforations without releasing the refill or the individual cleaning sheet from the gripping means, such that when the outermost sheet becomes soiled, the midportion of the sheet may be peeled away to expose a portion of a non-soiled sheet.

27. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a cleaning layer having an outward face for cleaning and an opposed inward face, the outward face of each of the cleaning layers configured to contact a surface to be cleaned and thereby become soiled;

each cleaning sheet having a front edge portion and an opposed rear edge portion with a midportion defined therebetween, the front edge portions of each of the cleaning sheets being bonded to each other and the rear edge portions of each of the cleaning sheets being bonded to each other so as to retain the cleaning sheets in the stacked configuration;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and each of the cleaning sheets having a weakened area between the front edge portion and the midportion and another weakened area between the rear edge portion and the midportion such that the midportion is separable from the stack of cleaning sheets by separating the sheet at the weakened areas without releasing the refill or the individual cleaning sheet from the gripping means, such that when the outermost sheet becomes soiled, the midportion of the sheet may be peeled away to expose a portion of a non-soiled sheet.

28. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a backing layer and a cleaning layer attached to the backing layer such that the cleaning layer defines an outward face of the cleaning sheet and the backing layer defines an inward face of the cleaning sheet, the outward face of each of the cleaning sheets configured to contact a surface to be cleaned and thereby become soiled;

each cleaning sheet having a front edge portion and an opposed rear edge portion with a midportion defined therebetween, the front edge portions of each of the cleaning sheets being bonded to each other and the rear edge portions of each of the cleaning sheets being bonded to each other so as to retain the cleaning sheets in the stacked configuration;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and a portion of each of the cleaning sheets being separable from the stack of cleaning sheets without releasing the refill or the individual cleaning sheet from the gripping means, such that when the outermost sheet becomes soiled, the separable portion of the sheet may be peeled away to expose a portion of a non-soiled sheet.

29. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a backing layer and a cleaning layer attached to the backing layer such that the cleaning layer defines an outward face of the cleaning sheet and the backing layer defines an inward face of the cleaning sheet, the outward face of each of the cleaning sheets configured to contact a surface to be cleaned and thereby become soiled;

each cleaning sheet having a front edge portion and an opposed rear edge portion with a midportion defined therebetween, the front edge portions of each of the cleaning sheets being bonded to each other and the rear edge portions of each of the cleaning sheets being bonded to each other so as to retain the cleaning sheets in the stacked configuration, the backing layers 1 of each cleaning sheet being larger than the cleaning layers such that portions of each of the backing layers project forwardly and rearwardly beyond the cleaning layer to define a front and rear margin, the front margins being bonded to each other to form the bonded front edge portions and the rear margins being bonded to each other to form the bonded rear edge portions;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and a portion of each of the cleaning sheets being separable from the stack of cleaning sheets without releasing the refill or the individual cleaning sheet from the gripping means, such that when the outermost sheet becomes soiled, the separable portion of the sheet may be peeled away to expose a portion of a non-soiled sheet.

30. The refill according to claim 29, wherein the backing layer is plastic and the cleaning layer is a non-woven material.

31. The refill according to claim 29, wherein the backing layer is paper.

32. The refill according to claim 29, wherein each backing layer comprises a first non-woven material and each cleaning layer comprises a second non-woven material.

33. The refill according to claim 32, wherein the first and second non-woven materials are the same material.

34. The refill according to claim 32, wherein the first non-woven material is thinner than the second non-woven material.

35. The refill according to claim 32, wherein the first non-woven material is denser than the second non-woven material.

36. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a cleaning layer having an outward face for cleaning and an opposed inward face, the outward face of each of the cleaning layers configured to contact a surface to be cleaned and thereby become soiled;

each cleaning sheet having a front edge portion and an opposed rear edge portion with a midportion defined therebetween, the midportion of each of the cleaning sheets having a first thickness and the front and rear edge portions of each of the cleaning sheets having a second thickness less than the first thickness, the front edge portions of each of the cleaning sheets being bonded to each other and the rear edge portions of each of the cleaning sheets being bonded to each other so as to retain the cleaning sheets in the stacked configuration;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and a portion of each of the cleaning sheets being separable from the stack of cleaning sheets without releasing the refill or the individual cleaning sheet from the gripping means, such that when the outermost sheet becomes soiled, the separable portion of the sheet may be peeled away to expose a portion of a non-soiled sheet.

37. The refill according to claim 36, wherein each of the cleaning sheets is a non-woven material.

38. A refill for a cleaning implement of the type having a head with a lower surface and an upper surface, the upper surface having gripping means thereon, the refill comprising:

a plurality of coextensive cleaning sheets disposed in a stacked configuration, each cleaning sheet comprising a cleaning layer having an outward face for cleaning and an opposed inward face, the outward face of each of the cleaning layers configured to contact a surface to be cleaned and thereby become soiled;

each cleaning sheet having a front edge portion and an opposed rear edge portion with a midportion defined therebetween, the front edge portions of each of the cleaning sheets being bonded to each other and the rear edge portions of each of the cleaning sheets being bonded to each other so as to retain the cleaning sheets in the stacked configuration, the bonded front and rear edge portions being compressed and sonically or beat bonded such that the overall thickness of the edge portions of the stack are significantly reduced in comparison to the overall thickness of the midportion of the stack;

the stack of cleaning sheets configured to be wrapped about the head of the cleaning implement such that the bonded front edge portions and rear edge portions engage the gripping means on the upper surface of the cleaning implement head and the midportions of each of the cleaning sheets is disposed on the lower surface of the cleaning implement head; and a portion of each of the cleaning sheets being separable from the stack of cleaning sheets without releasing the refill or the individual cleaning sheet from the gripping means, such that when the outermost sheet becomes soiled, the separable portion of the sheet may be peeled away to expose a portion of a non-soiled sheet.

39. The refill according to claim 38, wherein the overall thickness of the midportion is 3 or more times the overall thickness of the bonded portions.

40. The refill according to claim 38, wherein the overall thickness of the midportion is 6 or more times the overall thickness of the bonded portions.

41. The refill according to claim 38, wherein the overall thickness of the midportion is 8 or more times the overall thickness of the bonded portions.

42. A refill for a mop of the type having a mop head with a lower surface and an opposed upper surface interconnected by a leading and a trailing edge, the mop head having gripping means provided on the upper surface for retaining a cleaning sheet on the mop head, the refill comprising:

a plurality of cleaning sheets each having a front edge portion, a rear edge portion, and a midportion therebetween, the midportion having a bottom face comprising a cleaning layer, the edge portions having a thickness less than the midportion;

the front edge portions of the cleaning sheets being bonded together to form a front connection area; and the rear edge portions of the cleaning sheets being bonded together to form a rear connection area.

43. The refill according to claim 42, wherein the plurality of cleaning sheets comprises at least 5 sheets and the front and rear connection areas have a thickness less than ¼ inch.

44. The refill according to claim 42, wherein the plurality of cleaning sheets have an thickness in the midportion of ½ inch or more and the front and rear connection areas have an overall thickness less than ¼ inch.

45. The refill according to claim 44, wherein the overall thickness of the front and rear connection areas is less than ⅛ inch.

46. The refill according to claim 42, wherein the plurality of cleaning sheets has an overall thickness in the midportion that is at least three times the overall thickness of the front and rear connection areas.

47. The refill according to claim 42, wherein the plurality of cleaning sheets has an overall thickness in the midportion that is at least six times the overall thickness of the front and rear connection areas.

48. The refill according to claim 42, wherein the plurality of cleaning sheets has an overall thickness in the midportion that is at least eight times the overall thickness of the front and rear connection areas.

* * * * *

UNITED STATES PATENT AND TRADEMARK OFFICE

CERTIFICATE OF CORRECTION

PATENT NO. : 6,810,554 B2
DATED : November 2, 2004
INVENTOR(S) : William D. McKay It is certified that error appears in the above-identified patent and that said Letters Patent is hereby corrected as shown below:

Column 2,
Line 23, replace “included” with -- includes --.
Line 29, replace “removable” with -- removably --.
Line 38, after “non-woven material” insert -- and in other embodiments a cleaning layer, which may be a non-woven material, --.

Column 3,
Line 32, after “top” insert -- plan --.

Column 4,
Line 26, replace “side” with -- sides --.
Line 34, replace “removable” with -- removably --.

Column 5,
Line 6, replace “an-outward” with -- an outward --.

Column 8,
Line 55, replace “cleaning-material-” with -- cleaning material --.

Signed and Sealed this

Sixth Day of December, 2005

JON W. DUDAS
*Director of the United States Patent and Trademark Office*